US009158233B2

(12) United States Patent
Yamazaki et al.

(10) Patent No.: US 9,158,233 B2
(45) Date of Patent: Oct. 13, 2015

(54) CONVEYANCE DEVICE, DEVELOPMENT DEVICE INCLUDING CONVEYANCE DEVICE, AND IMAGE FORMING APPARATUS INCLUDING DEVELOPMENT DEVICE

(71) Applicant: KYOCERA DOCUMENT SOLUTIONS INC., Osaka (JP)

(72) Inventors: Hiroshi Yamazaki, Osaka (JP); Eiji Nimura, Osaka (JP); Kuniaki Nakano, Osaka (JP); Koji Kuramashi, Osaka (JP); Yoshihiro Yamagishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 83 days.

(21) Appl. No.: 13/897,200

(22) Filed: May 17, 2013

(65) Prior Publication Data

US 2013/0315628 A1 Nov. 28, 2013

(30) Foreign Application Priority Data

May 25, 2012 (JP) ..... 2012-119251

(51) Int. Cl.
*G03G 15/08* (2006.01)

(52) U.S. Cl.
CPC ..... *G03G 15/0839* (2013.01); *G03G 15/0877* (2013.01); *G03G 15/0893* (2013.01)

(58) Field of Classification Search
CPC ..... G03G 15/0831; G03G 15/0822; G03G 15/0877
USPC ..... 399/255, 256
See application file for complete search history.

(56) References Cited

U.S. PATENT DOCUMENTS

| | | | | |
|---|---|---|---|---|
| 5,923,931 | A * | 7/1999 | Kishimoto | 399/256 |
| 2002/0071697 | A1* | 6/2002 | Fujimoto | 399/254 |
| 2005/0123321 | A1* | 6/2005 | Buhay-Kettelkamp et al. | 399/254 |
| 2010/0196059 | A1* | 8/2010 | Maeshima | 399/263 |
| 2012/0163873 | A1* | 6/2012 | Mihara et al. | 399/254 |

FOREIGN PATENT DOCUMENTS

JP 2004-307140 A 11/2004

* cited by examiner

*Primary Examiner* — Ryan Walsh
*Assistant Examiner* — Philip Marcus T Fadul
(74) *Attorney, Agent, or Firm* — Studebaker & Brackett PC

(57) ABSTRACT

A conveyance device includes a housing, a formation member, and a detection section. The housing has a first conveyance path, a second conveyance path, and a first communication path. The first and second conveyance paths each are a conveyance path for conveying a developer. The first communication path allows a first end portion of the first conveyance path and a first end portion of the second conveyance path to be in communication with each other via a communication surface. The communication surface has a first region and a second region. The formation member forms the second region of the communication surface so that a height of the second region from a bottom portion of the first communication path is lower than a height of the first region from the bottom portion of the first communication path. The detection section detects the amount of the developer.

18 Claims, 14 Drawing Sheets

CONVEYANCE DEVICE, DEVELOPMENT DEVICE INCLUDING CONVEYANCE DEVICE, AND IMAGE FORMING APPARATUS INCLUDING DEVELOPMENT DEVICE

INCORPORATION BY REFERENCE

The present application claims priority under 35 U.S.C. §119 to Japanese Patent Application No. 2012-119251, filed May 25, 2012. The contents of this application are incorporated herein by reference in their entirety.

BACKGROUND ART

The present disclosure relates to conveyance devices in which a developer is conveyed, development devices including such a conveyance device, and image forming apparatuses including such a development device.

A development device circulates and conveys a developer between a first conveyance path and a second conveyance path which are provided in a development housing. The developer is conveyed in the first and second conveyance paths by respective stirring screws provided in the first and second conveyance paths. A conveyance direction in the first conveyance path is opposite to a conveyance direction of the second conveyance path. The stirring screws of the development devices each include a shaft portion, and a plurality of helical parts which are joined successively around the shaft portion. The developer is conveyed in the conveyance direction by the stirring screws being driven to rotate in the development housing.

If the adhesiveness of the developer increases due to degradation of the developer, the developer may adhere to the shaft portion of the stirring screw. If the developer adheres to the shaft portion, the shaft portion, in effect, has a larger thickness. As a result, the conveyance performance of the stirring screw decreases. A type of stirring screw does not include a shaft portion at a middle portion in the axial direction. In other words, such a stirring screw has a hollow shape.

Compared to the stirring screw including the shaft portion extending in the axial direction, the stirring screw having the hollow shape tends to have lower performance in terms of conveyance of the developer in the axial direction. A means for detecting the amount of the developer may be provided in a region which is located on a downstream side of the first conveyance path in which the stirring screw having the hollow shape is provided, and faces a communication path between the first and second conveyance paths. The developer amount detecting means detects the amount of the developer in the first conveyance path. The developer amount detecting means includes an eddy current sensor etc. The eddy current sensor outputs a voltage value which varies depending on the amount of the developer which is conveyed in the communication path while facing the eddy current sensor. The amount of the developer in the first conveyance path is detected based on the voltage value.

SUMMARY

A conveyance device according to a first aspect of the present disclosure includes a housing, a formation member, and a detection section. The housing has a first conveyance path, a second conveyance path, and a first communication path. The first conveyance path is a conveyance path for conveying a developer. The second conveyance path is a conveyance path for conveying the developer. The first communication path allows a first end portion of the first conveyance path and a first end portion of the second conveyance path to be in communication with each other via a communication surface. The communication surface has a first region and a second region. The formation member forms the second region of the communication surface so that a height of the second region from a bottom portion of the first communication path is lower than a height of the first region from the bottom portion of the first communication path. The detection section is provided downstream of the formation member in the first conveyance path and detects the amount of the developer.

A development device according to a second aspect of the present disclosure includes the conveyance device of the first aspect, and a development roller. The development roller is provided along the second conveyance path and is rotatably supported by the housing. The development roller carries the developer.

An image forming apparatus according to a third aspect of the present disclosure includes the development device of the second aspect, and an image carrier. The image carrier has a circumferential surface on which an electrostatic latent image is to be formed, and is disposed to face the development roller.

DETAILED DESCRIPTION

Figure 1:
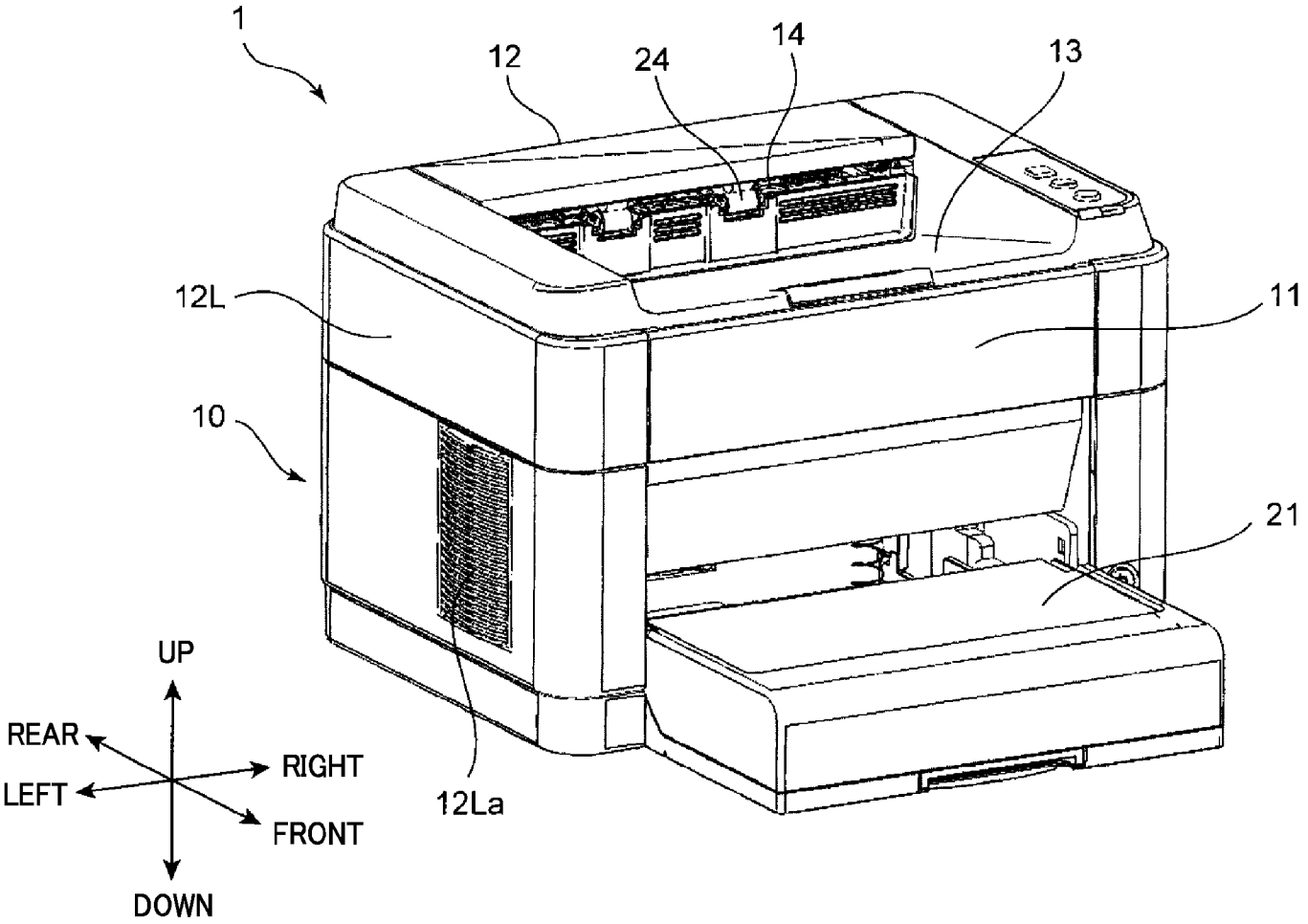
FIG. 1 is a perspective view showing an external appearance of an image forming apparatus according to one embodiment of the present disclosure.

Embodiments of the present disclosure will be described in detail hereinafter with reference to the accompanying drawings. The same or corresponding parts are designated by the same reference characters in the drawings and will not be redundantly described.

Figure 2:
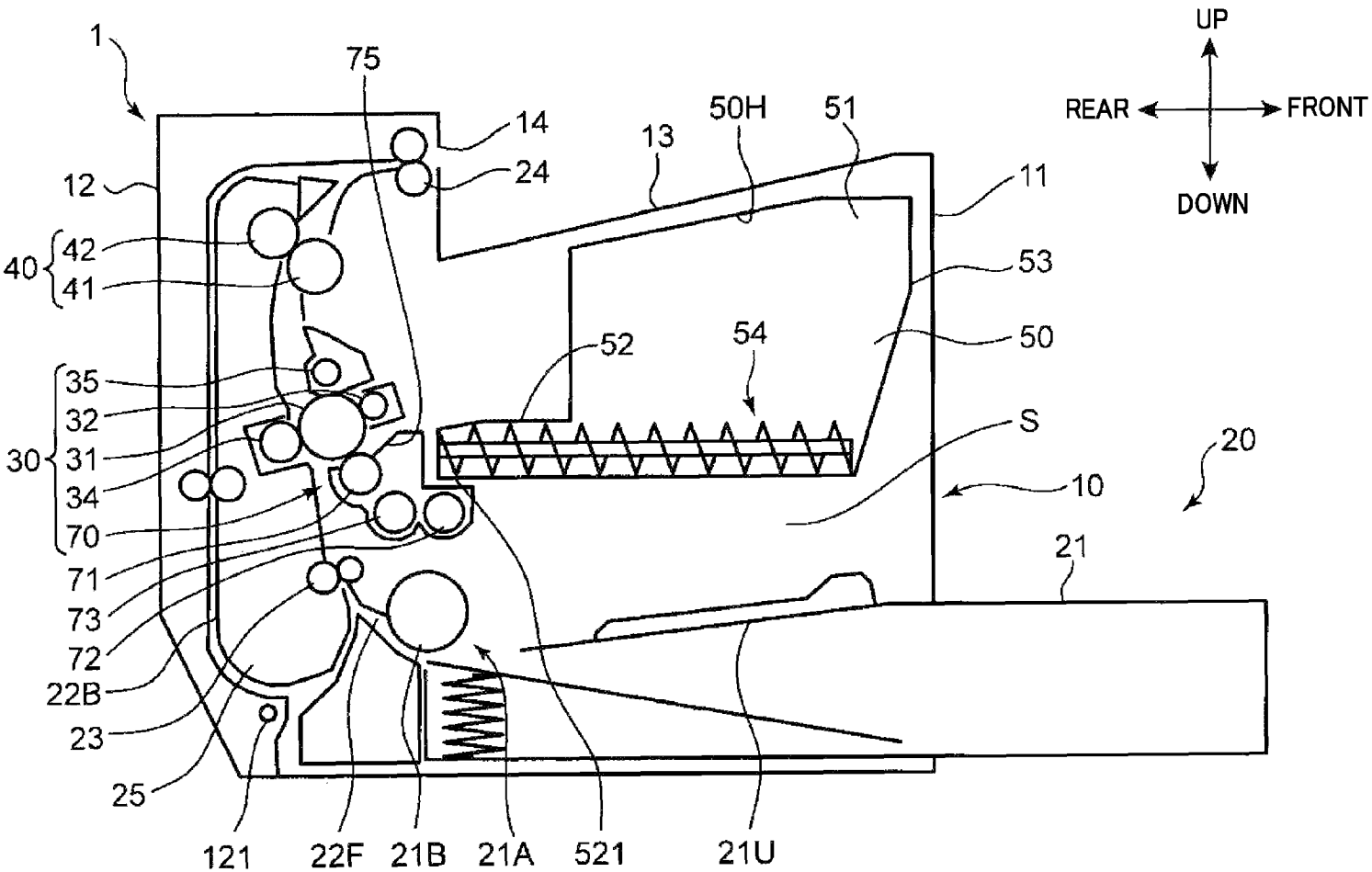
FIG. 2 is a cross-sectional side view showing an internal structure of the image forming apparatus of the embodiment of the present disclosure.

FIG. 1 is a perspective view showing an external appearance of an image forming apparatus 1 according to one embodiment of the present disclosure. FIG. 2 is a cross-sectional side view showing an internal structure of the image forming apparatus 1 of the embodiment of the present disclosure. In this embodiment, the image forming apparatus 1 is exemplified by a monochromatic printer. However, the image forming apparatus of the embodiment of the present disclosure may be a copier, a fax machine, or a multifunction peripheral having these functions, or an image forming apparatus which forms a color image.

The image forming apparatus 1 includes a body housing 10, a paper feed section 20, an image forming section 30, a fusing section 40, and a toner container 50. The body housing 10 has a generally rectangular parallelepiped shape. The paper feed section 20, the image forming section 30, the fusing section 40, and the toner container 50 are accommodated in the body housing 10.

The body housing 10 includes a front cover 11 at a front surface thereof and a rear cover 12 at a rear surface thereof. When the front cover 11 is opened, the toner container 50 is exposed at the front surface. As a result, when the image forming apparatus 1 runs out of toner, the user can remove the toner container 50 through the front surface of the body housing 10. The rear cover 12 is opened for sheet jam clearance or maintenance. When the rear cover 12 is opened, a unit including the image forming section 30 and a unit including the fusing section 40 can each be removed through the rear surface of the body housing 10. The body housing 10 includes, at side surfaces thereof, a left cover 12L (FIG. 1) and a right cover 12R (not shown in FIG. 1) each of which extends in a vertical direction. The right cover 12R is provided on the opposite side with respect to the left cover 12L. An air inlet 12La for taking air into the body housing 10 is provided at a front portion of the left cover 12L. A paper exit section 13 onto which a sheet after image formation is to be exited is provided at an upper surface of the body housing 10. Devices for forming an image are provided in an internal space S shown in FIG. 2. The internal space S is formed by the front cover 11, the rear cover 12, the left cover 12L, the right cover 12R, and the paper exit section 13.

The paper feed section 20 includes a paper feed cassette 21 which stores sheets on which an image is to be formed (FIG. 2). A portion of the paper feed cassette 21 protrudes forward from the front surface of the body housing 10. An upper surface of a portion of the paper feed cassette 21 which is accommodated in the body housing 10 is covered by a paper feed cassette top plate 21U. The paper feed cassette 21 includes a sheet storage space in which a stack of sheets is stored, a lift plate which lifts up the stack of sheets for paper feed, and the like. A sheet pickup section 21A is provided at an upper portion of a rear end portion of the paper feed cassette 21. A feed roller 21B is provided in the sheet pickup section 21A. The feed roller 21B picks up an uppermost sheet of the sheet stack in the paper feed cassette 21 on a sheet-by-sheet basis.

The image forming section 30 performs an image forming process. The image forming process is a process of forming a toner image on a sheet fed from the paper feed section 20. The image forming section 30 includes a photoconductive drum 31 (image carrier), a charging device 32, an exposure device (not shown in FIG. 2), a development device 70, a transfer roller 34, and a cleaning device 35. The charging device 32, the exposure device, the development device 70, the transfer roller 34, and the cleaning device 35 are disposed around the photoconductive drum 31. The image forming section 30 is disposed between the left and right covers 12L and 12R.

The photoconductive drum 31 includes a rotating shaft (not shown), and a cylinder which rotates about the rotating shaft. On a circumferential surface (hereinafter referred to as a "cylinder surface") of the cylinder, an electrostatic latent image is formed, and a toner image corresponding to an electrostatic latent image is carried. The photoconductive drum 31 may be one which is formed, for example, of an amorphous silicon (a-Si)-based material.

The charging device 32 includes a charging roller which comes into contact with the photoconductive drum 31. The charging device 32 uniformly charges the surface of the photoconductive drum 31.

The cleaning device 35 has a cleaning blade (not shown) to clean toner adhering to the cylinder surface of the photoconductive drum 31 after transfer of a toner image. The cleaning device 35 also conveys the cleaned toner to a collection device (not shown). The photoconductive drum 31, the charging device 32, and the cleaning device 35 are integrated together to form a drum unit.

The exposure device has optical elements, such as a laser light source, a mirror, a lens, and the like. The exposure device irradiates the cylinder surface of the photoconductive drum 31 with light to form an electrostatic latent image. The irradiation light is modulated by the exposure device based on image data input from an external apparatus, such as a personal computer or the like. The development device 70 supplies toner to the cylinder surface of the photoconductive drum 31 in order to develop the electrostatic latent image formed on the cylinder surface of the photoconductive drum 31 and thereby form a toner image. The development device 70 includes a development roller 71, and a first conveyance screw 72 and a second conveyance screw 73. The development roller 71 carries toner which is to be supplied to the photoconductive drum 31. The first and second conveyance screws 72 and 73 convey and circulate a developer in the development housing while stirring the toner. Note that the development device 70 will be described below with reference to FIGS. 3A, 3B, 4-14, 15A, and 15B.

The transfer roller 34 is used to transfer the toner image formed on the cylinder surface of the photoconductive drum 31 to a sheet. The transfer roller 34 comes into contact with the cylinder surface of the photoconductive drum 31 to form a transfer nip. A transfer bias having a polarity opposite to that of the toner is applied to the transfer roller 34.

The fusing section 40 performs a fusing process. The fusing process is a process of fusing the transferred toner image to a sheet. The fusing section 40 includes a fixing roller 41 and a pressure roller 42. The fixing roller 41 includes a heat source in an interior thereof. The pressure roller 42 is pressed against and contacts the fixing roller 41. As a result, a fusing nip is formed between the pressure roller 42 and the fixing roller 41. When the sheet to which the toner image has been transferred is passed through the fusing nip, the toner image is fused to the sheet due to heat of the fixing roller 41 and pressure of the pressure roller 42.

The toner container 50 stores toner which is to be replenished to the development device 70. The toner container 50 includes a container body 51, a cylindrical portion 52, a lid member 53, and a rotating member 54. The container body 51 is a main portion in which the toner is stored. The cylindrical portion 52 protrudes from a lower portion of a rear surface of the container body 51. The lid member 53 covers a front surface of the container body 51. The rotating member 54 is accommodated in an interior of the container and conveys the toner. The toner stored in the toner container 50 is supplied from a toner outlet 521 to the development device 70 by the rotating member 54 being driven to rotate. The toner outlet 521 is provided in a lower surface at a tip of the cylindrical portion 52. A container top plate 50H which covers an upper portion of the toner container 50 is disposed below the paper exit section 13.

In the body housing 10, a main conveyance path 22F and a reverse conveyance path 22B are formed in order to convey a sheet. The main conveyance path 22F extends from the sheet pickup section 21A of the paper feed section 20 through the image forming section 30 and the fusing section 40 to a paper exit opening 14. The paper exit opening 14 is disposed to face the paper exit section 13 at the upper surface of the body housing 10. The reverse conveyance path 22B, when duplex printing is performed on a sheet, serves as a conveyance path for conveying the sheet on one side of which printing has been performed. The reverse conveyance path 22B returns the sheet on one side of which printing has been performed, to an upstream side of the image forming section 30 in the main conveyance path 22F.

The main conveyance path 22F is formed to pass through the transfer nip in a direction from a bottom portion to an upper portion of the image forming apparatus 1. The transfer nip is formed by the photoconductive drum 31 and the transfer roller 34. A registration roller pair 23 is provided upstream of the transfer nip in the main conveyance path 22F. A sheet is temporarily stopped by the registration roller pair 23 so that skew is corrected, and thereafter, is fed to the transfer nip with predetermined timing for image transfer. A plurality of transfer rollers for conveying a sheet are provided at appropriate points in the main conveyance path 22F and the reverse conveyance path 22B. For example, a paper exit roller pair 24 is provided in the vicinity of the paper exit opening 14.

The reverse conveyance path 22B is formed between an outer surface of a reversal section 25 and an inner surface of the rear cover 12 of the body housing 10. Note that the transfer roller 34 and one roller of the registration roller pair 23 are disposed at the inner surface of the reversal section 25. The rear cover 12 and the reversal section 25 can each rotate about the axis of a pivot portion 121 provided at a lower end thereof. When a sheet jam occurs in the reverse conveyance path 22B, the rear cover 12 is opened. When a sheet jam occurs in the main conveyance path 22F, or when a unit including the photoconductive drum 31 or the development device 70 is removed from the imaging forming apparatus 1, the reversal section 25 is also opened in addition to the rear cover 12.

<Detailed Configuration of Development Device>

Figure 3B:
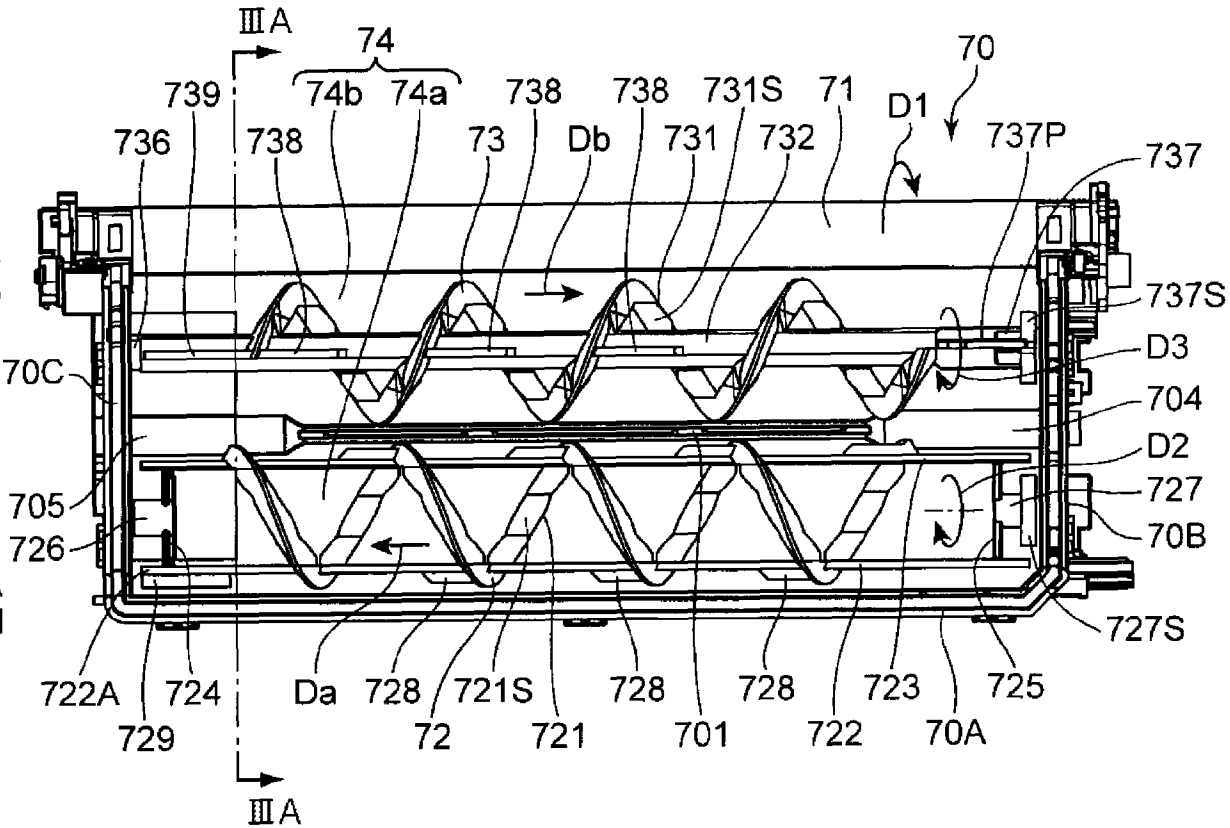
FIGS. 3A and 3B are plan views showing an internal structure of a development device according to the embodiment of the present disclosure.
Figure 3A:
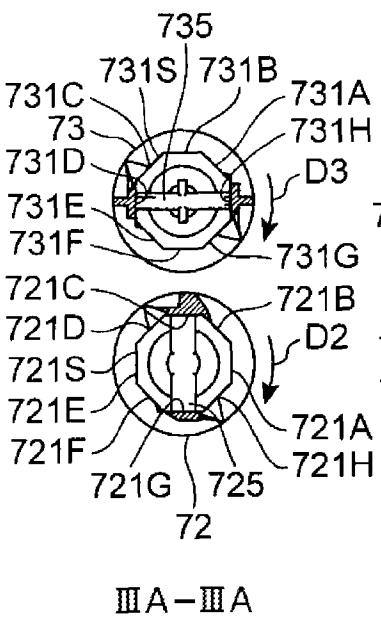

Next, a configuration of the development device 70 of this embodiment will be described in detail with reference to FIGS. 3A and 3B. FIG. 3A is a cross-sectional view of the first and second conveyance screws 72 and 73 provided in the development device 70, taken along line IIIA-IIIA (FIG. 3B). FIG. 3B is a plan view of the development housing 70A of the development device 70. Note that FIG. 3B shows the development device 70 from which a lid portion 70D is removed (see FIG. 9).

The development device 70 includes the development housing 70A (housing) which forms an internal space of the development device 70. The development device 70 also includes the lid portion 70D (lid) which covers an upper portion of the development housing 70A. The development housing 70A includes a pair of wall portions (walls), i.e., a first wall portion 70C and a second wall portion 70B.

The development housing 70A has a developer reservoir section 74. The developer reservoir section 74 is a cavity which stores a developer composed of toner which is a magnetic material. The developer reservoir section 74 conveys the developer while stirring the developer. In an interior of the development housing 70A, the development roller 71, a developer regulating blade 75 (FIG. 2), and the first conveyance screw 72 (first conveyance member) and the second conveyance screw 73 (second conveyance member) are provided. The developer regulating blade 75 is disposed to face the development roller 71. The first and second conveyance screws 72 and 73 stir and convey the developer.

The developer reservoir section 74 includes a first conveyance portion 74*a* (developer conveyance path, first conveyance path) and a second conveyance portion 74*b* (developer supply path, second conveyance path). The first and second conveyance portions 74*a* and 74*b* are formed between the first and second wall portions 70C and 70B, extending in a longitudinal direction of the development device 70. The first and second conveyance portions 74*a* and 74*b* are adjacent and parallel to each other. The first and second conveyance portions 74*a* and 74*b* are separated from each other by a separation plate 701. The separation plate 701 is integrally formed with a bottom portion of the development housing 70A, extending in the longitudinal direction of the development device 70.

One end portion (first end portion) of the first conveyance portion 74*a* and one end portion (first end portion) of the second conveyance portion 74*b* are in communication with each other via a first communication portion 705 (first communication path) (see FIG. 3B). These end portions of the first and second conveyance portions 74*a* and 74*b* are end portions in the longitudinal direction of the development device 70. The other end portion (second end portion) of the first conveyance portion 74*a* and the other end portion (second end portion) of the second conveyance portion 74*b* are in communication with each other via a second communication portion 704 (second communication path) (see FIG. 3B). These end portions of the first and second conveyance portions 74*a* and 74*b* are end portions in the longitudinal direction of the development device 70. The first communication portion 705 is disposed between the first wall portion 70C and the separation plate 701. The second communication portion 704 is disposed between the second wall portion 70B and the separation plate 701.

The first conveyance screw 72 is accommodated in the first conveyance portion 74*a*, and is rotated about an axis thereof to stir and convey the developer. The second conveyance screw 73 is accommodated in the second conveyance portion 74*b*, and is rotated about an axis thereof to stir and convey the developer. In other words, the first and second conveyance screws 72 and 73 are rotatably supported by the first and second wall portions 70C and 70B. In FIGS. 3A and 3B, the first conveyance screw 72 is driven to rotate in a direction indicated by an arrow D2. As a result, the first conveyance screw 72 conveys the developer in the first conveyance portion 74*a* in a direction (first direction) indicated by an arrow Da. On the other hand, the second conveyance screw 73 is driven to rotate in a direction indicated by an arrow D3. As a result, the second conveyance screw 73 conveys the developer in the second conveyance portion 74*b* in a direction (second direction) indicated by an arrow Db. In other words, the first and second conveyance screws 72 and 73 are set so that, in their axial directions, their developer conveyance directions are reverse (opposite) to each other. As a result, as indicated by the arrows Da and Db in FIG. 3B, the developer is conveyed between the first and second conveyance portions 74*a* and 74*b* to circulate while being stirred.

The development roller 71 is disposed along the longitudinal direction of the development device 70. The development roller 71 is disposed along the second conveyance screw 73. The development roller 71 is driven to rotate in a direction indicated by an arrow D1 in FIG. 3B. A fixed magnet role is provided in an interior of the development roller 71. The magnet role has a plurality of magnetic poles. The developer is supplied from the second conveyance screw 73 to a circumferential surface of the development roller 71. Thereafter, the developer carried on the circumferential surface of the development roller 71 is conveyed to a downstream side in the rotational direction of the development roller 71 as the development roller 71 is rotated.

The developer regulating blade 75 (FIG. 2) is disposed downstream of a region where the development roller 71 and the second conveyance screw 73 face each other, in the rotational direction of the development roller 71 in the circumferential direction of the development roller 71. The developer regulating blade 75 is provided in a lid portion (not shown) of the development housing 70A, extending in the axial direction of the development roller 71. The developer regulating blade 75 is a plate-like member whose tip portion is disposed at a predetermined distance from the circumferential surface of the development roller 71. The thickness of a layer of the developer carried on the development roller 71 is regulated by the developer regulating blade 75. The developer on the development roller 71 is conveyed to a portion where the development roller 71 and the photoconductive drum 31 face each other. Thereafter, the developer is supplied to the cylinder surface of the photoconductive drum 31 based on an electrostatic latent image formed on the photoconductive drum 31.

Figure 4:
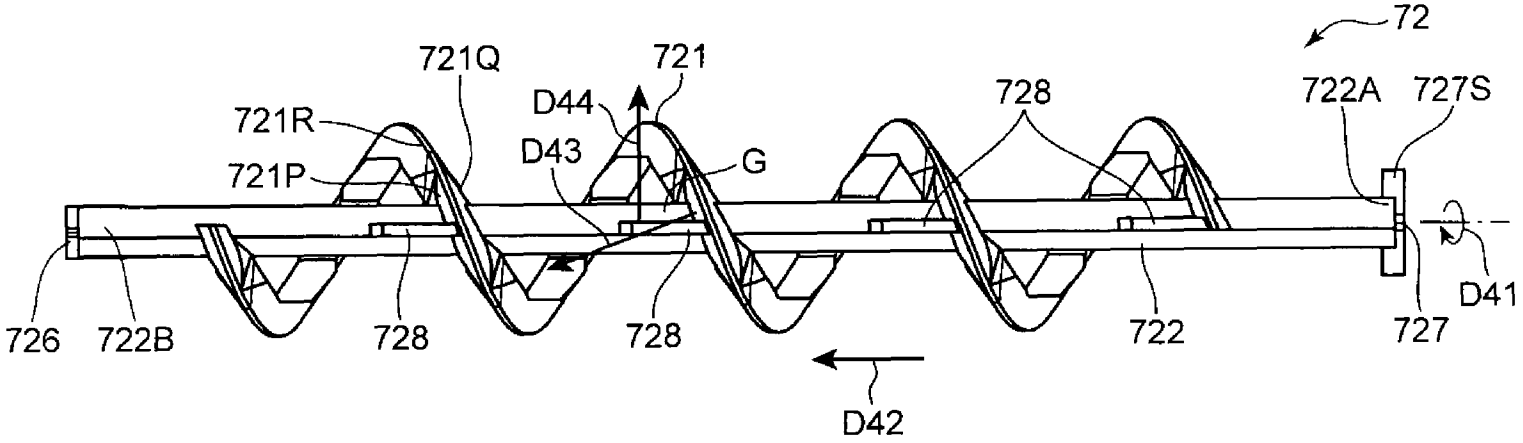
FIG. 4 is a front view showing a conveyance screw according to the embodiment of the present disclosure.
Figure 5:
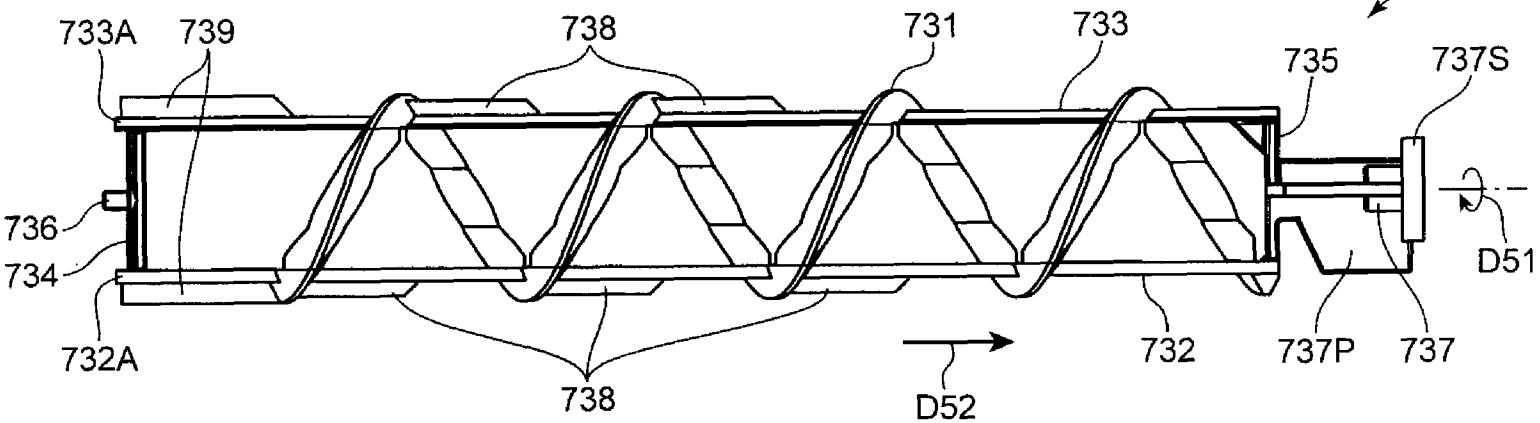
FIG. 5 is a plan view showing a conveyance screw of the embodiment of the present disclosure.
Figure 6:
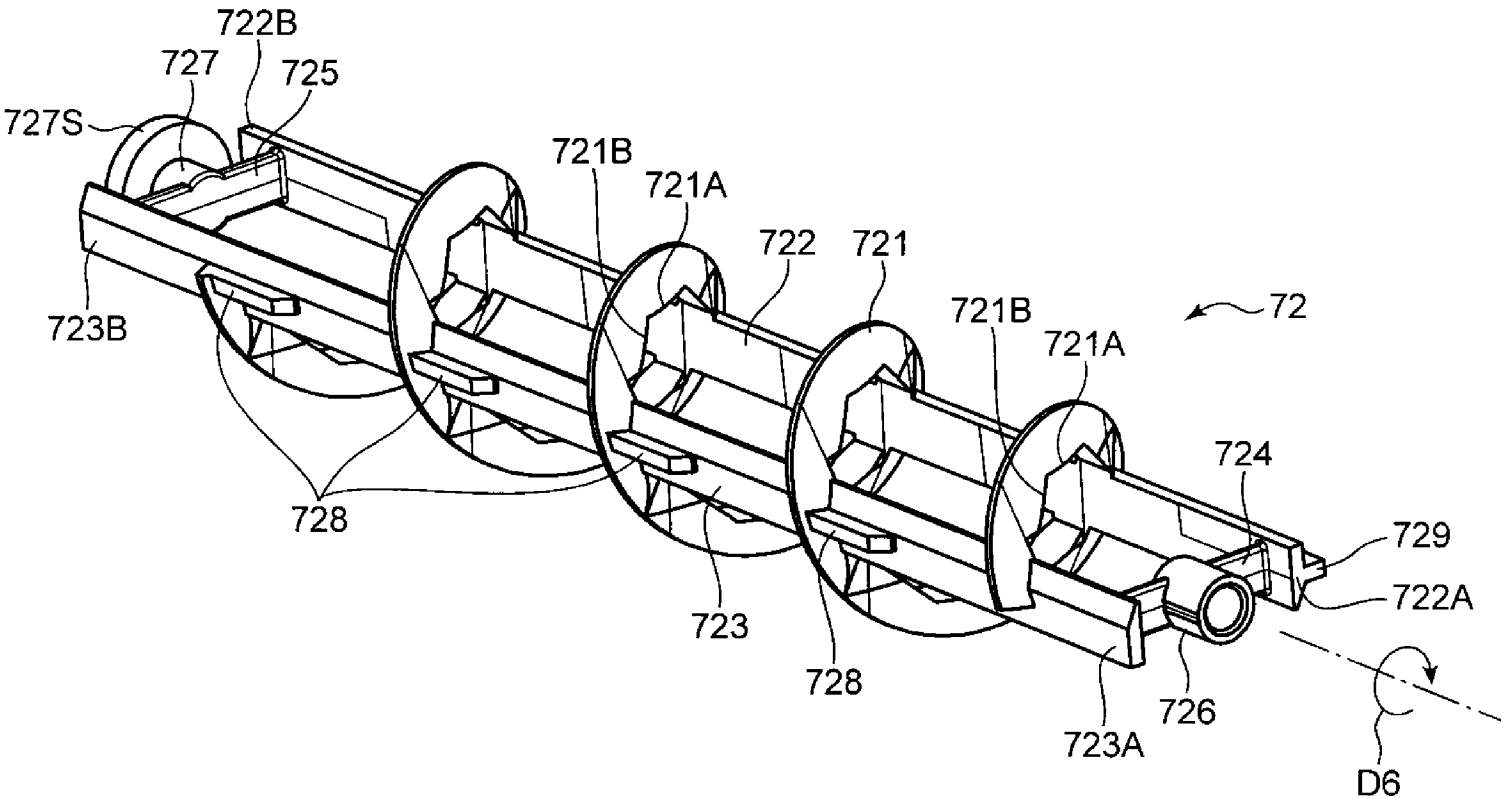
FIG. 6 is a perspective view showing the conveyance screw of the embodiment of the present disclosure.
Figure 7:
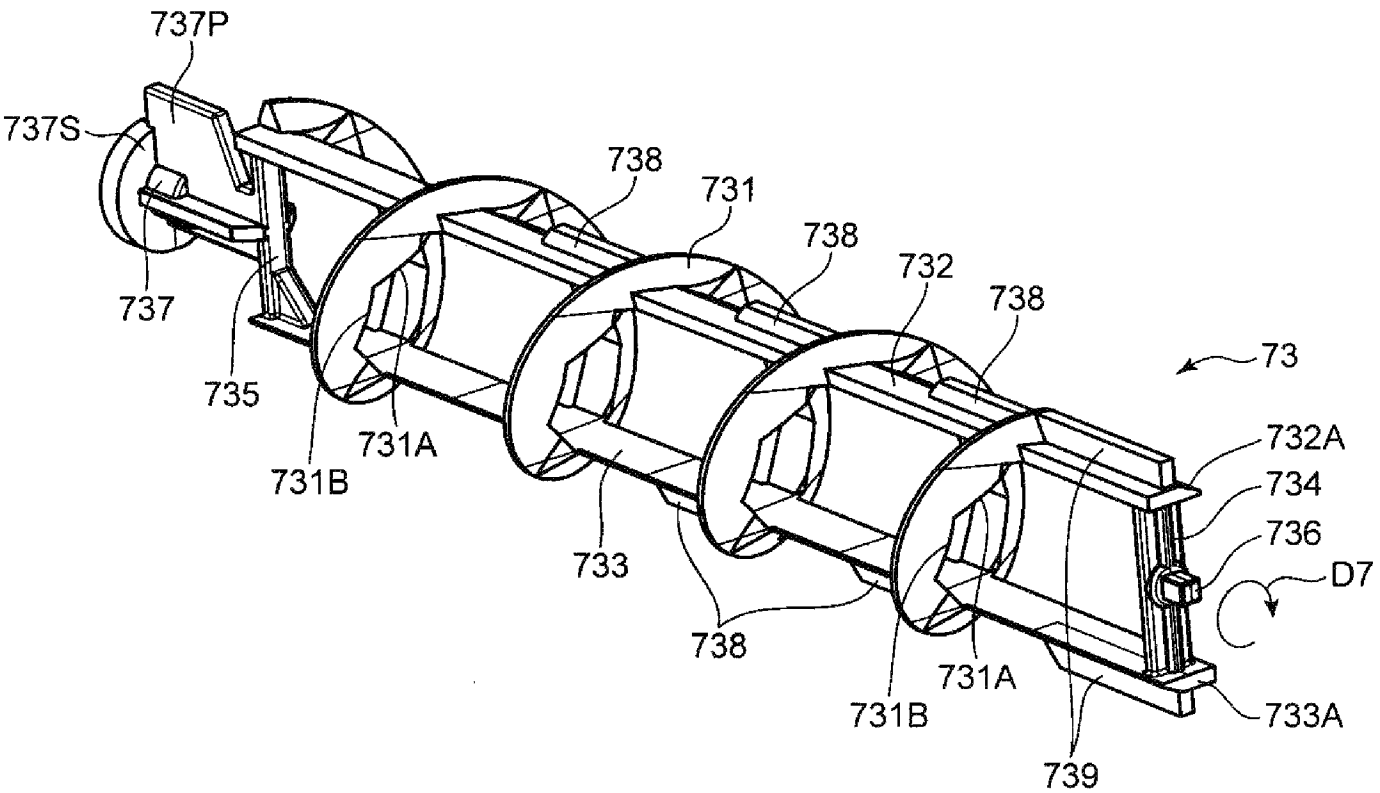
FIG. 7 is a perspective view showing the conveyance screw of the embodiment of the present disclosure.

Next, the first and second conveyance screws 72 and 73 provided in the development device 70 of this embodiment will be described in detail with reference to FIGS. 4-7 in addition to FIGS. 3A and 3B. FIG. 4 is a front view of the first conveyance screw 72. FIG. 5 is a plan view of the second conveyance screw 73. FIGS. 6 and 7 are perspective views of the first and second conveyance screws 72 and 73, respectively.

<First Conveyance Screw 72>

The first conveyance screw 72 (first conveyance member) will be described with reference to FIGS. 3A, 3B, 4, and 6. As described above, the first conveyance screw 72 is provided in the first conveyance portion 74*a*. The first conveyance screw 72 includes a first first-shaft portion 726, a second first-shaft portion 727, a first first-rib 722 (rib member, reinforcement member), a second first-rib 723 (rib member, reinforcement member), a first first-connection piece 724 (support member), a second first-connection piece 725, a first screw 721, and a first seal 727S.

The first and second first-shaft portions 726 and 727 are rotatably supported by the first and second wall portions 70C and 70B, respectively. The first and second first-shaft portions 726 and 727 are the axis of rotation of the first conveyance screw 72. The first first-shaft portion 726 rotatably supports the first conveyance screw 72 at one end portion in the axial direction of the first conveyance screw 72. The second first-shaft portion 727 rotatably supports the first conveyance screw 72 at the other end portion in the axial direction of the first conveyance screw 72. The first first-shaft portion 726 includes a cylindrical bearing portion in an interior thereof. A protruding portion (not shown) which protrudes from the first wall portion 70C of the development housing 70A toward the first conveyance portion 74*a* is inserted into the bearing portion of the first first-shaft portion 726. Similarly, the second first-shaft portion 727 includes a cylindrical bearing portion in an interior thereof. A protruding portion (not shown) which protrudes from the second wall portion 70B of the development housing 70A toward the first conveyance portion 74*a* is inserted into the bearing portion of the second first-shaft portion 727. As a result, the first conveyance screw 72 is rotatably supported by the development housing 70A. In this case, an imaginary axis of rotation of the first conveyance screw 72 is formed between the first and second first-shaft portions 726 and 727 in the axial direction of the first conveyance screw 72.

The first and second first-ribs 722 and 723 are each a plate-like member provided from one end portion to the other end portion of the first conveyance screw 72. The first and second first-ribs 722 and 723 are also each a plate-like member having a predetermined width in a circumferential direction of the first conveyance screw 72. The first and second first-ribs 722 and 723 are disposed on opposite sides of the axis of rotation of the first conveyance screw 72, extending in parallel to each other. In other words, the first and second first-ribs 722 and 723 are separated from each other by a spacing of 180 degrees in the circumferential direction of the first conveyance screw 72. The first and second first-ribs 722 and 723 are provided from the vicinity of the first first-shaft portion 726 to the vicinity of the second first-shaft portion 727 in the axial direction of the first conveyance screw 72. The first and second first-ribs 722 and 723 support the first screw 721 described below, and stir the developer in the first conveyance portion 74*a*. The first and second first-ribs 722 and 723 also reinforce the first screw 721.

The first first-connection piece 724 is disposed to face the first wall portion 70C. The first first-connection piece 724 connects one end portion of the first first-rib 722 and one end portion of the second first-rib 723 together in a radial direction of the first conveyance screw 72. In other words, both ends of the first first-connection piece 724 are joined to the one end portions of the first and second first-ribs 722 and 723. The first first-shaft portion 726 protrudes from a central portion of the first first-connection piece 724 outward in the axial direction of the first conveyance screw 72. In other words, the first first-connection piece 724 connects the end portion in the conveyance direction of the first first-rib 722 and the first first-shaft portion 726 together, and connects the end portion in the conveyance direction of the second first-rib 723 and the first first-shaft portion 726 together. Similarly, the second first-connection piece 725 connects the other end portion of the first first-rib 722 and the other end portion of the second first-rib 723 together in the radial direction of the first conveyance screw 72. In other words, both ends of the second first-connection piece 725 are joined to the other end portions of the first and second first-ribs 722 and 723. The second first-shaft portion 727 protrudes from a central portion of the second first-connection piece 725 outward in the axial direction of the first conveyance screw 72.

The first first-rib 722 has a first first-tip portion 722A (protruding portion) located closer to the outside than the first first-connection piece 724 in the axial direction of the first conveyance screw 72. The first first-tip portion 722A is formed by one end of the first first-rib 722 protruding outward beyond the first first-connection piece 724 in the axial direction of the first conveyance screw 72 (toward the first wall portion 70C). The first first-rib 722 has a first first-rear tip portion 722B located closer to the outside than the second first-connection piece 725 in the axial direction of the first conveyance screw 72. The first first-rear tip portion 722B is formed by the other end of the first first-rib 722 protruding outward beyond the second first-connection piece 725 in the axial direction of the first conveyance screw 72 (toward the second wall portion 70B).

Similarly, the second first-rib 723 has a second first-tip portion 723A (protruding portion) located closer to the outside than the first first-connection piece 724 in the axial direction of the first conveyance screw 72. The second first-tip portion 723A is formed by one end of the second first-rib 723 protruding outward beyond the first first-connection piece 724 in the axial direction of the first conveyance screw 72. The second first-rib 723 has a second first-rear tip portion 723B located closer to the outside than the second first-connection piece 725 in the axial direction of the first conveyance screw 72. The second first-rear tip portion 723B is formed by the other end of the second first-rib 723 protruding outward beyond the second first-connection piece 725 in the axial direction of the first conveyance screw 72.

The first screw 721 (helical member) is in the shape of a helix extending in the developer conveyance direction, and forms an outer circumferential periphery of the first conveyance screw 72. Specifically, the first screw 721 is a member which includes helical pieces each of which forms one turn of the helix and which are joined successively so that the member extends in the conveyance direction. The first screw 721 has a hollow interior formed by the helical pieces joined successively. In other words, the first screw 721 is a hollow conveyance member in which a plurality of helical pieces are joined successively so that the hollow conveyance member extends in the conveyance direction. In other words, the first screw 721 is a helical conveyance member having a hollow shape which is provided between the first and second first-shaft portions 726 and 727 and is located at a distance in the radial direction from the imaginary axis of rotation of the first conveyance screw 72.

The first and second first-ribs 722 and 723 connect contiguous (adjacent) helical pieces of the first screw 721 together. The configurations of the first screw 721, the first first-rib 722, and the second first-rib 723 will be described in a still different way. The first screw 721 includes a plurality of helical pieces which are integrated together by the pair of the first and second first-ribs 722 and 723. As a result, the helical first screw 721 has a hollow portion around the imaginary axis of rotation. Note that, as shown in FIGS. 3B, 4, and 6, both end portions in an axial direction of the first and second first-ribs 722 and 723 have regions where the first screw 721 is not provided. That axial direction is the axial direction of the first conveyance screw 72.

Referring to FIG. 4, the helical portion of the first screw 721 includes a ridge portion 721R, a plurality of inclined surfaces 721P, and a plurality of inclined surfaces 721Q. Each of the inclined surfaces 721P is paired with the corresponding one of the inclined surfaces 721Q. The ridge portion 721R forms an outer circumferential periphery at which the diameter of the first screw 721 is largest as viewed in cross section along the axis of rotation of the first conveyance screw 72. The inclined surface 721P is formed to extend from the ridge portion 721R toward the imaginary axis of rotation and face the first first-shaft portion 726. The inclined surface 721Q is formed to extend from the ridge portion 721R toward the imaginary axis of rotation and face the second first-shaft portion 727.

Also, a plurality of flat surface portions are provided inside the helical portion of the first screw 721. The flat surface portions are joined successively in the circumferential direction of the first conveyance screw 72. Specifically, in the first screw 721, the inclined surfaces 721P and 721Q in each pair are connected together by the corresponding flat surface portion inside (behind) the ridge portion 721R. The flat surface portions are disposed inside the ridge portion 721R along the axial direction of the first conveyance screw 72 while being bent at a predetermined angle.

The flat surface portions will be described with reference to FIG. 3A. A first inner wall portion 721S is provided at an inner circumferential portion of the first screw 721. The first inner wall portion 721S faces the hollow interior of the first screw 721. The first inner wall portion 721S is formed by the plurality of flat surface portions being joined successively at a predetermined angle in the circumferential direction of the first conveyance screw 72. A wall surface (i.e., surfaces of the flat surface portions joined successively) of the first inner wall portion 721S includes a plurality of first first-inner wall surfaces 721A, a plurality of second first-inner wall surfaces 721B, a plurality of third first-inner wall surfaces 721C, a plurality of fourth first-inner wall surfaces 721D, a plurality of fifth first-inner wall surfaces 721E, a plurality of sixth first-inner wall surfaces 721F, a plurality of seventh first-inner wall surfaces 721G, and a plurality of eighth first-inner wall surfaces 721H. As shown in FIG. 3A, the inner wall surfaces form a generally equilateral octagon as viewed in cross section perpendicular to the axial direction of the first conveyance screw 72. In other words, these inner wall surfaces are joined successively at the predetermined angle in the circumferential direction of the first conveyance screw 72. Here, the surface of each of the flat surface portions corresponds to one of the inner wall surfaces. Note that the third and seventh first-inner wall surfaces 721C and 721G correspond to the inner surfaces of the second and first first-ribs 723 and 722, respectively. In other words, the inner surfaces facing the hollow interior of the first screw 721, of the plate-like second and first first-ribs 723 and 722, form a portion of the inner wall surfaces of the first screw 721.

The first seal 727S is a ring-shaped elastic member which is provided on an outside in the radial direction of the second first-shaft portion 727. When the first screw 721 is mounted in the development housing 70A, the first seal 727S comes into contact with the inner wall surface of the second wall portion 70B of the development housing 70A. As a result, the first seal 727S prevents or reduces aggregation of the developer which would occur between the second first-shaft portion 727 and the inner wall surface of the second wall portion 70B, as the first conveyance screw 72 is rotated.

The first screw 721 also includes a plurality of first first-protruding portions 728 and a single second first-protruding portion 729 (protruding member).

The first first-protruding portions 728 are wall portions which protrude from outer wall portions of the first and second first-ribs 722 and 723 outward in the radial direction. The outer wall portions on which the first first-protruding portions 728 are provided are wall portions of the first and second first-ribs 722 and 723 which face outward in the radial direction of the first conveyance screw 72. Each of the first first-protruding portions 728 protrudes, in the radial direction of the first conveyance screw 72, to a height slightly lower (further inside) than the outer circumferential periphery of the first screw 721. In the axial direction of the first conveyance screw 72, a base end portion of each first first-protruding portion 728 is connected to one corresponding blade portion (hereinafter referred to as a "corresponding blade portion") of the first screw 721. The other end portion of each first first-protruding portion 728 is disposed between another blade portion (hereinafter referred to as a "contiguous blade portion") which is disposed contiguous (adjacent) to the corresponding blade portion, and the corresponding blade portion. In other words, in the first conveyance portion 74*a*, the first first-protruding portion 728 extends from the corresponding blade portion of the first screw 721 toward a direction (the arrow Da of FIG. 3, an arrow 42 in FIG. 4) in which the first conveyance screw 72 conveys the developer. In this case, a tip portion of the first first-protruding portion 728 in the direction in which the first first-protruding portion 728 extends is located at a substantially middle portion between the corresponding blade portion and the contiguous blade portion without being connected to the contiguous blade portion disposed contiguous to the corresponding blade portion.

Similarly, the second first-protruding portion 729 (FIG. 6) is a wall portion which protrudes from the outer wall portion of the first first-rib 722 outward in the radial direction. The outer wall portion on which the second first-protruding portion 729 is provided is a wall portion of the first first-rib 722 which faces outward in the radial direction of the first conveyance screw 72. The second first-protruding portion 729 is disposed at an end portion closer to the first first-shaft portion 726 of the first first-rib 722, extending over a predetermined length in the axial direction of the first conveyance screw 72. An outer end portion in an axial direction of the second first-protruding portion 729 and an outer end portion in the axial direction of the first first-tip portion 722A are formed in the same surface. That axial direction is the axial direction of the first conveyance screw 72.

<Second Conveyance Screw 73>

Next, the second conveyance screw 73 (second conveyance member) will be described with reference to FIGS. 3A, 3B, 5, and 7. Note that the second conveyance screw 73 has a shape similar to that of the first conveyance screw 72, and therefore, parts similar to those of the first conveyance screw 72 will not be described, and differences from the first conveyance screw 72 will be mainly described in detail. As described above, the second conveyance screw 73 is provided in the second conveyance portion 74*b*. The second conveyance screw 73 includes a first second-shaft portion 736, a second second-shaft portion 737, a first second-rib 732 (rib member, reinforcement member), a second second-rib 733 (rib member, reinforcement member), a first second-connection piece 734 (support member), a second second-connection piece 735, a paddle 737P, a second screw 731, and a second seal 737S.

The first and second second-shaft portions 736 and 737 correspond to the first and second first-shaft portions 726 and 727 of the first conveyance screw 72. The first and second second-shaft portions 736 and 737 allow the second conveyance screw 73 to be rotatably supported by the development housing 70A. In this case, the imaginary axis of rotation of the second conveyance screw 73 is formed between the first and second second-shaft portions 736 and 737, extending in the axial direction of the second conveyance screw 73.

The first and second second-ribs 732 and 733 correspond to the first and second first-ribs 722 and 723 of the first conveyance screw 72. The first and second second-connection pieces 734 and 735 correspond to the first and second first-connection pieces 724 and 725 of the first conveyance screw 72. Note that, as shown in FIG. 5, the second second-connection piece 735 is disposed further inside than the second second-shaft portion 737 in the axial direction of the second conveyance screw 73, with a predetermined distance between the second second-connection piece 735 and the second second-shaft portion 737. The first and second second-ribs 732 and 733 are also provided further inside than the second second-shaft portion 737 in the axial direction of the second conveyance screw 73, extending to a region located at a predetermined distance from the second second-shaft portion 737. The first and second second-ribs 732 and 733 are connected together by the second second-connection piece 735.

The first second-rib 732 has a first second-tip portion 732A which is located closer to the outside than the first second-connection piece 734 in the axial direction of the second conveyance screw 73. The first second-tip portion 732A is formed by one end of the first second-rib 732 protruding outward beyond the first second-connection piece 734 in the axial direction of the second conveyance screw 73 (toward the first wall portion 70C). Similarly, the second second-rib 733 has a second second-tip portion 733A which is located closer to the outside than the first second-connection piece 734 in the axial direction of the second conveyance screw 73. The second second-tip portion 733A is formed by one end of the second second-rib 733 protruding outward beyond the first second-connection piece 734 in the axial direction of the second conveyance screw 73. Note that the first and second second-ribs 732 and 733 of the second conveyance screw 73 extend to a portion where the first and second second-ribs 732 and 733 intersect the second second-connection piece 735, and do not extend beyond the second second-connection piece 735 outward in the axial direction of the second conveyance screw 73, unlike the first conveyance screw 72.

The paddle 737P is a plate-like member which is disposed on an outside in an axial direction of the second second-connection piece 735. That axial direction is the axial direction of the second conveyance screw 73. The paddle 737P is formed to extend from the axis of rotation of the second conveyance screw 73 in the radial direction. In this embodiment, the paddle 737P extends in the axial direction of the second conveyance screw 73 toward the first second-rib 732. The second second-shaft portion 737 is provided at an outer portion in an axial direction of the paddle 737P. The second seal 737S described below is provided at an outer end edge in the axial direction of the paddle 737P. That axial direction is the axial direction of the second conveyance screw 73. The paddle 737P transfers the developer from the second conveyance portion 74*b* to the first conveyance portion 74*a* via the second communication portion 704.

The second screw 731 corresponds to the first screw 721 of the first conveyance screw 72. The second screw 731 also has a shape similar to that of the first screw 721 as viewed in cross section along the axial direction of the first conveyance screw 72.

In particular, referring to FIG. 3A, a second inner wall portion 731S is provided at an inner circumferential portion of the second screw 731. The second inner wall portion 731S is formed by a plurality of flat surface portions joined successively at a predetermined angle. A wall surface (i.e., surfaces of the flat surface portions joined successively) of the second inner wall portion 731S includes a plurality of first second-inner wall surfaces 731A, a plurality of second second-inner wall surfaces 731B, a plurality of third second-inner wall surfaces 731C, a plurality of fourth second-inner wall surfaces 731D, a plurality of fifth second-inner wall surfaces 731E, a plurality of sixth second-inner wall surfaces 731F, a plurality of seventh second-inner wall surfaces 731G, and a plurality of eighth second-inner wall surfaces 731H. As shown in FIG. 3A, these inner wall surfaces form a generally equilateral octagon as viewed in cross section perpendicular to the axial direction of the second conveyance screw 73. Here, the surface of each of the flat surface portions corresponds to one of the inner wall surfaces. Note that the fourth and eighth second-inner wall surfaces 731D and 731H correspond to the inner surfaces of the plate-like second and first second-ribs 733 and 732, respectively.

The second seal 737S is a circular ring-shaped elastic member which is provided on an outside in the radial direction of the second second-shaft portion 737. When the second conveyance screw 73 is mounted in the development housing 70A, the second seal 737S comes into contact with the inner wall surface of the second wall portion 70B of the development housing 70A. As a result, the second seal 737S prevents or reduces aggregation of the developer which would occur between the second second-shaft portion 737 and the inner wall surface of the second wall portion 70B, as the second conveyance screw 73 is rotated.

The second conveyance screw 73 also includes a plurality of first second-protruding portions 738 and two second second-protruding portions 739. The first second-protruding portions 738 correspond to the first first-protruding portions 728 of the first conveyance screw 72.

On the other hand, the two second second-protruding portions 739 are a pair of wall portions which protrude from the outer wall portions of the first and second second-ribs 732 and 733, respectively, outward in the radial direction. The outer wall portions at which the second second-protruding portions 739 are provided are the wall portions of the first and second second-ribs 732 and 733 which face outward in the radial direction of the second conveyance screw 73. The second second-protruding portions 739 are disposed at end portions closer to the first second-shaft portion 736 of the first and second second-ribs 732 and 733, extending over a predetermined length in the axial direction of the second conveyance screw 73. Note that outer end portions in the axial direction of the first and second second-tip portions 732A and 733A protrude slightly outward beyond end portions in the axial direction of the second second-protruding portions 739. A length in an axial direction of the second second-protruding portion 739 is set to be longer than that of the first second-protruding portion 738. That axial direction is the axial direction of the second conveyance screw 73.

<Functions of First and Second Conveyance Screws 72 and 73>

Referring to FIGS. 3B and 6, the first and second first-tip portions 722A and 723A actively stir the developer accumulated in the vicinity of the first wall portion 70C as the first conveyance screw 72 rotates. The first and second first-tip portions 722A and 723A protrude from the first first-connection piece 724 outward in the axial direction of the first conveyance screw 72. Note that if the first first-connection piece 724 connects the first and second first-tip portions 722A and 723A together (i.e., the first and second first-tip portions 722A and 723A do not protrude outward in the axial direction of the first conveyance screw 72), the first first-connection piece 724 strongly presses the developer accumulated between the first first-connection piece 724 and the first wall portion 70C against the first wall portion 70C.

In this case, the developer accumulated between the first first-connection piece 724 and the first wall portion 70C is likely to aggregate. Therefore, in this embodiment, the first and second first-tip portions 722A and 723A are disposed to protrude from the first first-connection piece 724 outward in the axial direction of the first conveyance screw 72. As a result, the developer is effectively stirred. Because the flowability of the developer stirred increases, the developer is moved from the first communication portion 705 to the second conveyance portion 74*b*. In this case, the movement of the developer from the first conveyance portion 74*a* to the second conveyance portion 74*b* is accelerated by rotation of the second first-protruding portion 729 of the first conveyance screw 72.

When the developer flowability decreases due to high temperature environment and/or degradation of the developer, the developer is likely to be accumulated in the hollow interior of the first screw 721. As a result, the developer may aggregate into a cylindrical shape whose outer diameter is largest at the inner wall portion of the first screw 721. Such aggregation is significant when the developer is a single-component developer. When the developer is a double-component developer, which contains toner and a carrier, the carrier has the function of preventing or reducing aggregation of the toner. If the inner wall of the first screw 721 has successive curved surfaces in the circumferential direction, the developer disposed further inside than the inner wall is more likely to aggregate into a cylindrical shape.

On the other hand, the first conveyance screw 72 of this embodiment has the first inner wall portion 721S. Specifically, the first inner wall portion 721S is formed by successively joining a plurality of flat surface portions together at a predetermined angle. As shown in FIG. 3A, the first inner wall portion 721S forms a generally equilateral octagon as viewed in cross section perpendicular to the axial direction of the first conveyance screw 72. When the inner wall of the first screw 721 is viewed in cross section from the imaginary axis of rotation of the first conveyance screw 72, the trajectory of the inner wall of the first screw 721 varies between a surface portion typified by the first first-inner wall surface 721A and an intersection portion between a plurality of surfaces as the first screw 721 rotates. In other words, the cross-sectional shape of the first inner wall portion 721S has a non-uniform diameter rather than having a circle shape with a uniform inner diameter. Because the cross-sectional shape of the first inner wall portion 721S has a non-uniform diameter, the aggregation (clump) of the developer residing in the hollow interior of the first screw 721 is easily cut and broken as the first screw 721 rotates. As a result, even when the developer flowability decreases, the first inner wall portion 721S breaks the toner inside the first screw 721. Therefore, in the interior of the first screw 721, the aggregation of the developer into a cylindrical shape is prevented or reduced.

The first first-protruding portion 728 (FIG. 6) and the first second-protruding portion 738 (FIG. 7) partially reduce the developer conveyance performance in the axial direction of the first and second conveyance screws 72 and 73. In FIG. 4, the first conveyance screw 72 is driven to rotate in a direction indicated by an arrow D41. Of the developer in the first conveyance portion 74*a*, the developer located at a wedge-shaped portion G between the first screw 721 and the first first-protruding portion 728, is moved by the first screw 721 in a direction indicated by an arrow D43 of FIG. 4.

However, the developer strikes the first first-protruding portion 728 and is thereby moved in a direction indicated by an arrow D44. In other words, the movement of the developer in the axial direction by the first screw 721 is converted by the first first-protruding portion 728 into the movement in the circumferential direction. As a result, a conveyance force in the axial direction to the developer located between the first screw 721 and the first first-protruding portion 728 is reduced. Specifically, in the axial direction of the first conveyance screw 72, the conveyance performance in the axial direction of the first conveyance screw 72 is partially reduced, depending on the portions where the first first-protruding portions 728 are disposed. Note that, also in the second conveyance screw 73, by providing the first second-protruding portion 738, the conveyance performance in the axial direction of the second conveyance screw 73 is partially reduced.

Figure 8:
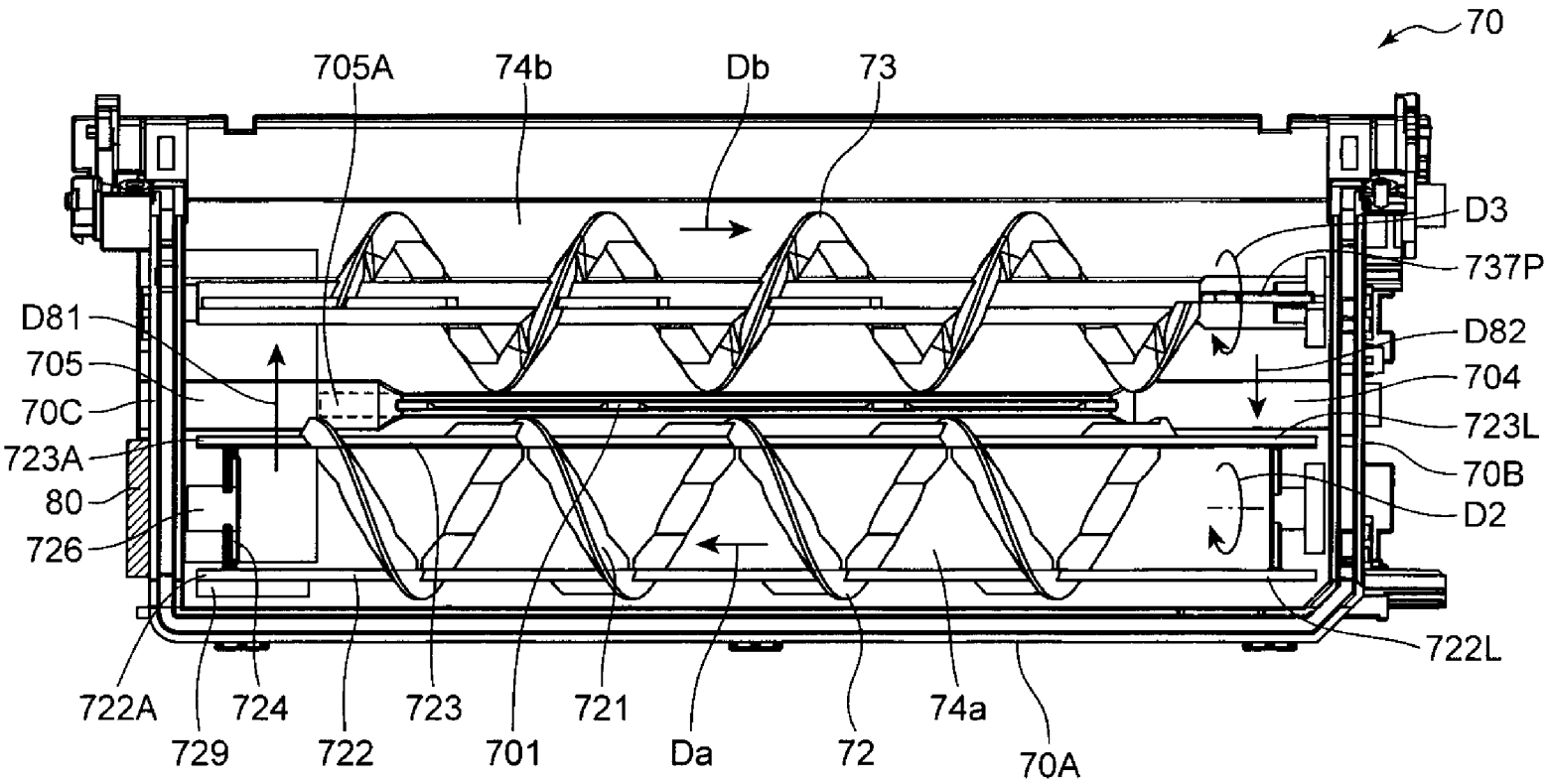
FIG. 8 is a plan view showing an internal structure of the development device of the embodiment of the present disclosure.

The development device 70 also includes a toner sensor 80. FIG. 8 is a plan view of the development housing 70A of the development device 70 as viewed from above as in FIG. 3. The development device 70 includes the toner sensor 80 in a region of the first wall portion 70C which faces the first conveyance portion 74*a*. The toner sensor 80 is an eddy current type sensor. The toner sensor 80 is disposed at the first wall portion 70C on a downstream side in the conveyance direction of the first conveyance portion 74*a*, facing the first and second first-tip portions 722A and 723A. The toner sensor 80 detects the amount of the developer which is conveyed to circulated in the development housing 70A (hereinafter referred to as "the amount of the developer" or "the developer amount"). Specifically, the toner sensor 80 outputs a voltage value corresponding to a pressure which is applied to the first wall portion 70C by the developer (toner) distributed on the inner side of the first wall portion 70C of the first conveyance portion 74*a*. As a result, the toner sensor 80 detects the amount of the developer stored in the developer reservoir section 74 of the development housing 70A.

<Influence of Degradation of Developer on Toner Sensor>

As shown in FIGS. 4-7, in this embodiment, the first and second conveyance screws 72 and 73 have a hollow shape. Therefore, the first and second conveyance screws 72 and 73 are likely to have lower developer conveyance performance in the axial direction than that of a typical conveyance member. The typical conveyance member has a shaft portion as the central axis, and a helical shape around the shaft portion. As a result, the typical conveyance member does not have a hollow interior.

In order to describe an influence of degradation of the developer on the toner sensor 80, the behavior of the developer in the absence of an auxiliary separation plate 90 (see FIGS. 9-12) in the development device 70 will be described hereinafter. In FIG. 8, when a brand-new developer is used and therefore the flowability of the developer is high, the developer is conveyed like a low viscous fluid in the developer reservoir section 74. Therefore, the difference in surface position of the developer is small over a wide range of the developer in the developer reservoir section 74. In other words, the developer is substantially uniformly distributed in the developer reservoir section 74 in terms of the difference in surface position of the developer in the developer reservoir section 74. Specifically, a portion of the developer which is conveyed in the first conveyance portion 74*a* by the first conveyance screw 72, flows from the vicinity of a downstream side of the separation plate 701 in the conveyance direction (the arrow Da) through the first communication portion 705 into the second conveyance portion 74*b*. Moreover, the rest of the developer in the first conveyance portion 74*a* flows through the first communication portion 705 into the second conveyance portion 74*b* after reaching the inner wall portion of the first wall portion 70C. Therefore, the amount of the developer in the developer reservoir section 74 is successfully detected by the toner sensor 80.

On the other hand, when the developer degrades and therefore the flowability of the developer decreases, the lower conveyance performance in the axial direction of the first conveyance screw 72 causes most of the developer to flow through the first communication portion 705 into the second conveyance portion 74*b* after being conveyed along the separation plate 701. In other words, it is difficult for the developer to reach the first wall portion 70C at which the toner sensor 80 is provided. In this case, the surface position of the developer is higher in a region along the separation plate 701 than at the inner wall portion of the first wall portion 70C. Therefore, the toner sensor 80 outputs a voltage value corresponding to a developer amount which is smaller than the amount of the developer which is actually stored in the developer reservoir section 74. Thus, when the first conveyance screw 72 having a hollow shape is used in the development device 70, the detection of the developer amount by the toner sensor 80 may become unstable.

Figure 9:
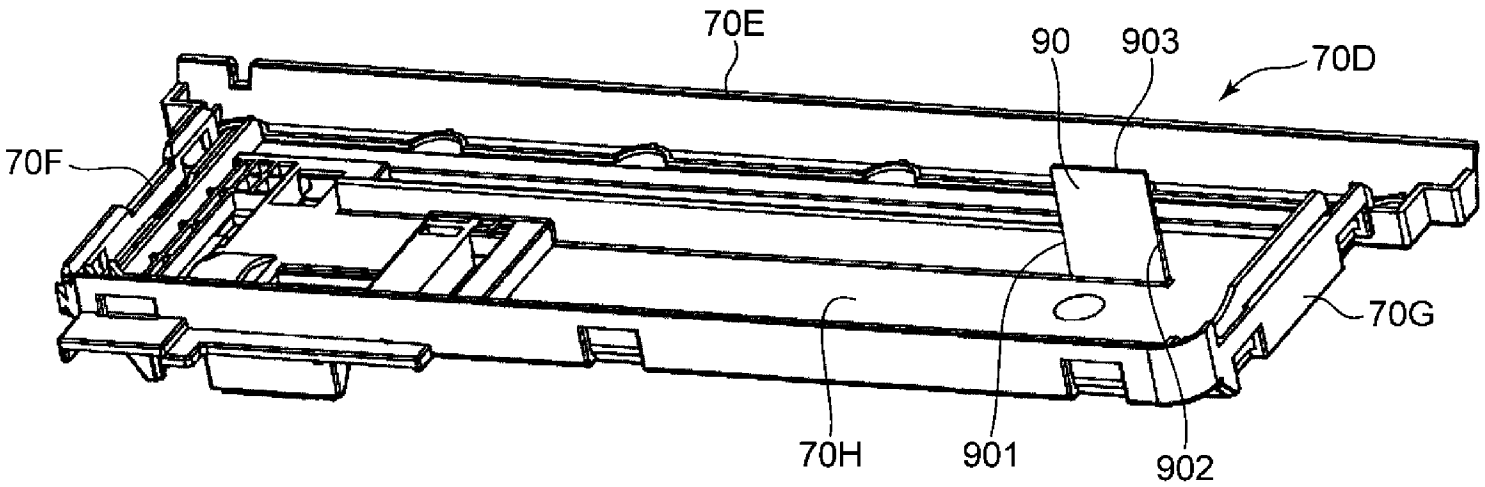
FIG. 9 is a perspective view showing a lid portion of the development device of the embodiment of the present disclosure.
Figure 10:
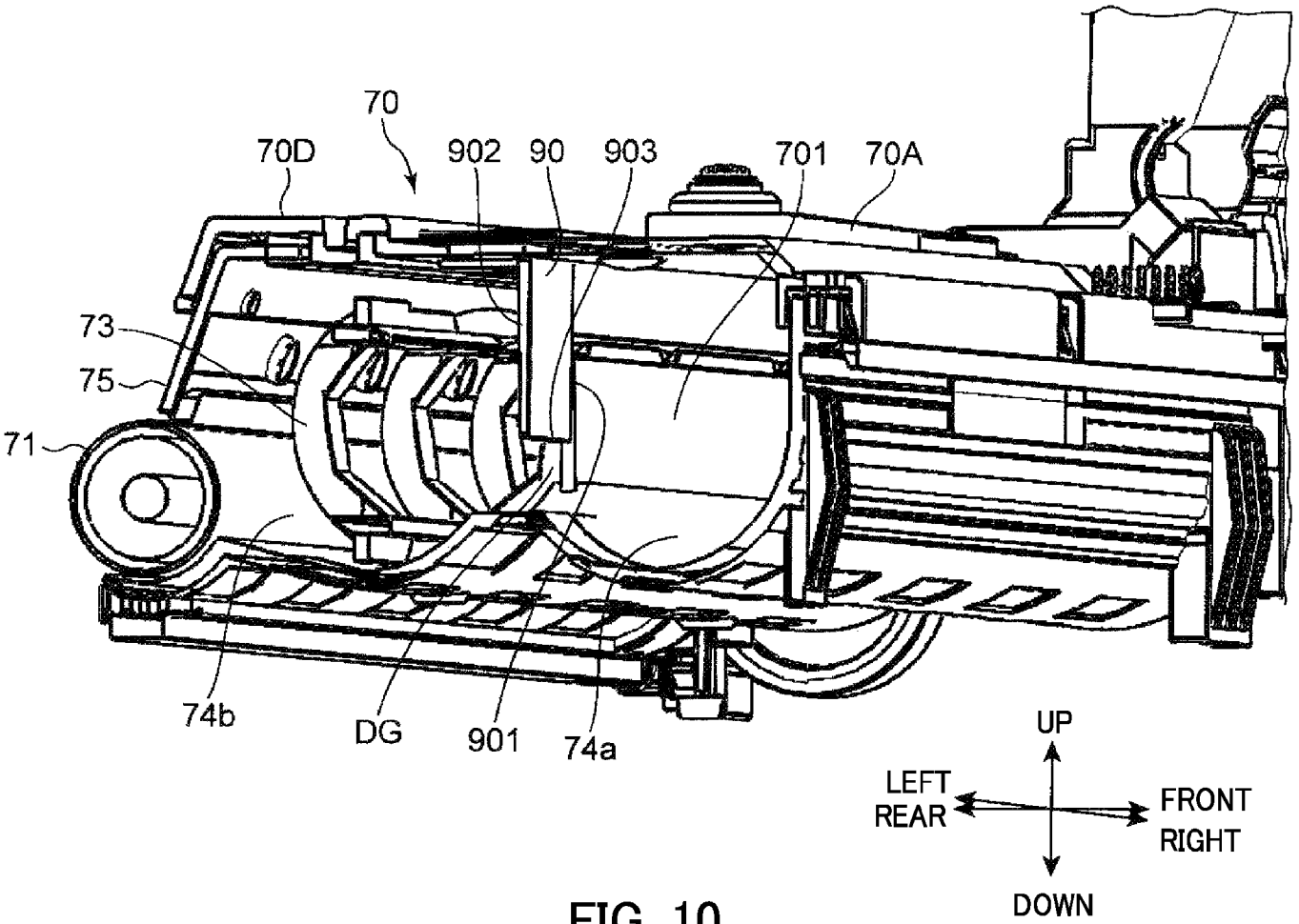
FIG. 10 is a cross-sectional perspective view showing the development device of the embodiment of the present disclosure.

Therefore, in this embodiment, the auxiliary separation plate 90 (formation member) is provided in the development device 70. FIG. 9 is a perspective view of the lid portion 70D of the development device 70. FIG. 10 is a cross-sectional perspective view of the development device 70 in which the lid portion 70D is mounted to the development housing 70A.

Referring to FIG. 9, the lid portion 70D is a rectangular plate-like member which covers an upper portion of the development housing 70A. The lid portion 70D has a longer edge 70E, a first lateral edge 70F, a second lateral edge 70G, and a top plate 70H. When the lid portion 70D is mounted to an upper portion of the development housing 70A, the longer edge 70E is disposed above the development roller 71. The first and second lateral edges 70F and 70G are disposed above the second and first wall portions 70B and 70C. The top plate 70H surrounded by the longer edge 70E and the first and second lateral edges 70F and 70G covers an upper portion of the developer reservoir section 74 of the development housing 70A.

The lid portion 70D also includes the auxiliary separation plate 90. The auxiliary separation plate 90 is a plate-like member which is provided to protrude from the top plate 70H of the lid portion 70D in a substantially vertical direction. The auxiliary separation plate 90 has a pair of lateral edges (i.e., a first lateral edge 901 and a second lateral edge 902), and a lower end edge 903 on the opposite side with respect to the top plate 70H.

Referring to FIG. 10, when the lid portion 70D is mounted to the development housing 70A, the auxiliary separation plate 90 is disposed successive to an end portion closer to the first wall portion 70C of the separation plate 701 of the development housing 70A. In other words, the first lateral edge 901 of the auxiliary separation plate 90 is disposed along an end edge of the separation plate 701 of the development housing 70A so that the auxiliary separation plate 90 and the separation plate 701 are disposed successive to each other. The second lateral edge 902 of the auxiliary separation plate 90 is disposed, facing the first wall portion 70C. As a result, the auxiliary separation plate 90 is disposed at an end portion 705A (FIG. 8) closer to the separation plate 701 of the first communication portion 705, above a bottom portion of the development housing 70A with a distance therebetween. In this case, the lower end edge 903 of the auxiliary separation plate 90 is disposed, facing the bottom portion of the development housing 70A with the distance therebetween. The auxiliary separation plate 90 blocks a portion of the first communication portion 705 which is located above an upstream region in the conveyance direction of the first conveyance screw 72. Referring to FIG. 10, thus, a spacing formed below the auxiliary separation plate 90 is defined as an auxiliary communication portion DG (auxiliary communication path). Thus, the auxiliary separation plate 90 is a member which forms the auxiliary communication portion DG.

<Auxiliary Communication Portion DG>

Figure 11:
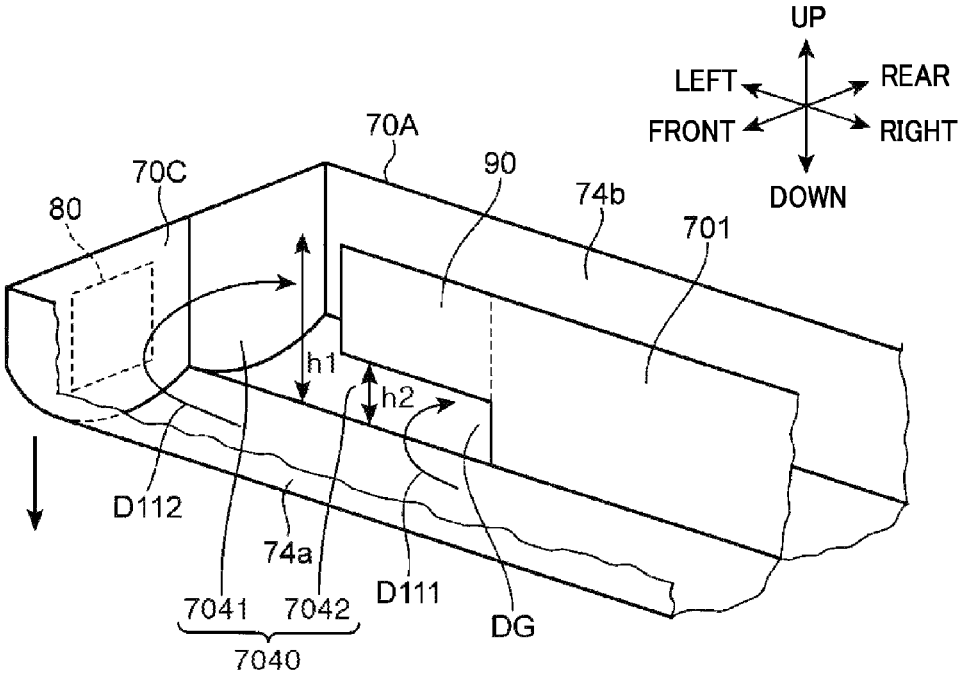
FIG. 11 is a schematic perspective view showing a flow of a developer in the development device of the embodiment of the present disclosure.
Figure 12:
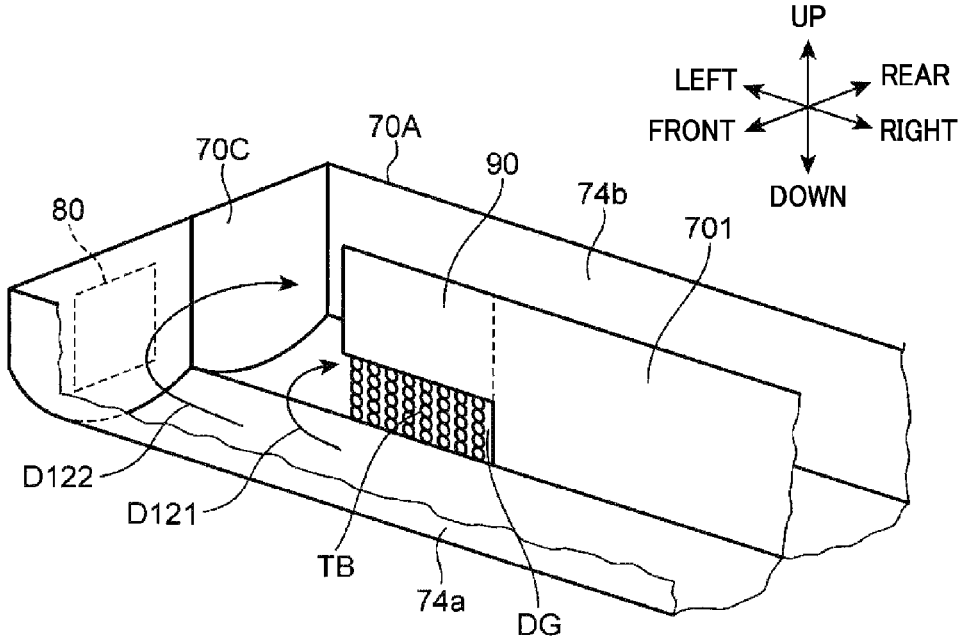
FIG. 12 is a schematic perspective view showing a flow of the developer in the development device of the embodiment of the present disclosure.
Figure 13:
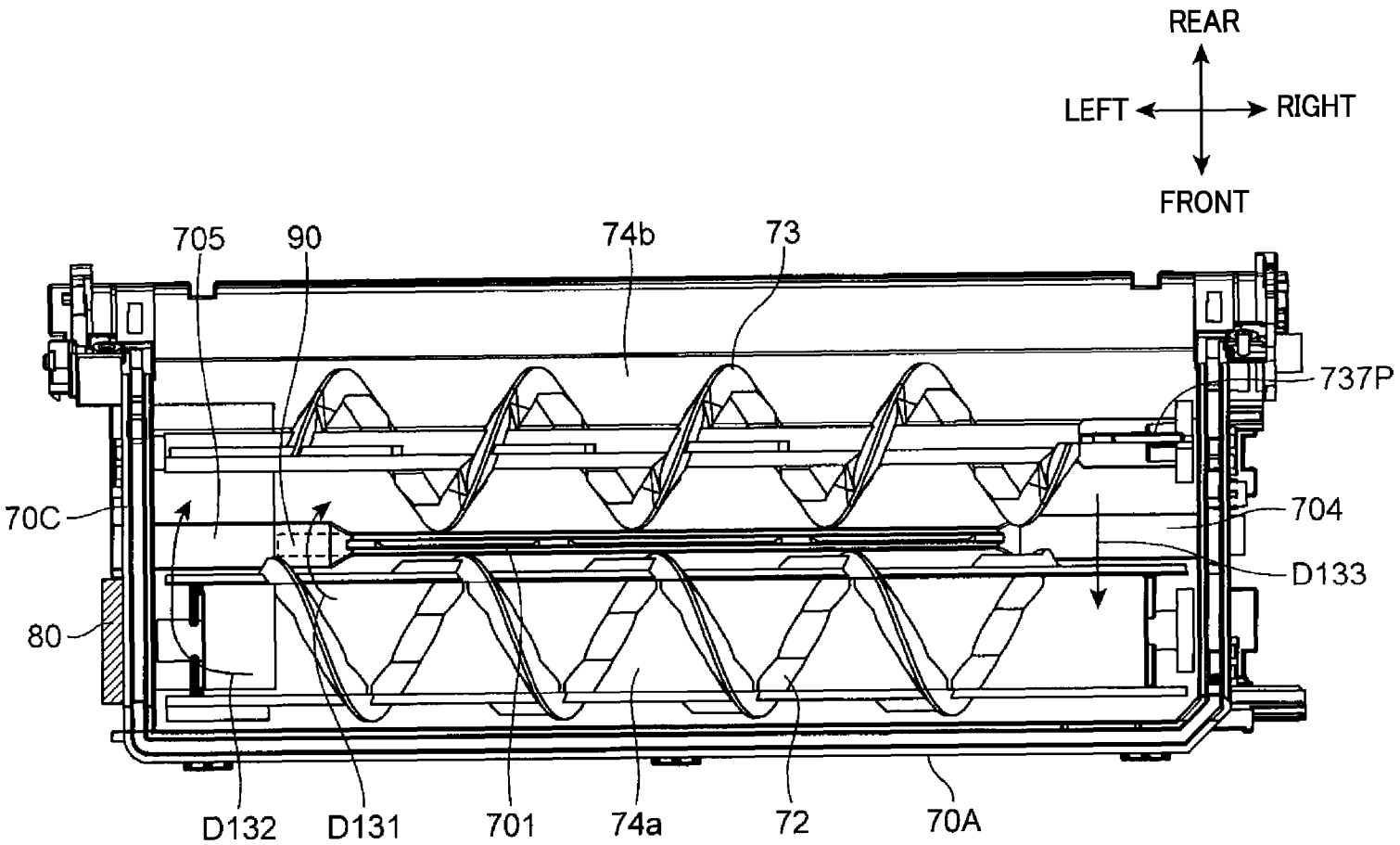
FIG. 13 is a plan view showing a flow of the developer in the development device of the embodiment of the present disclosure.
Figure 14:
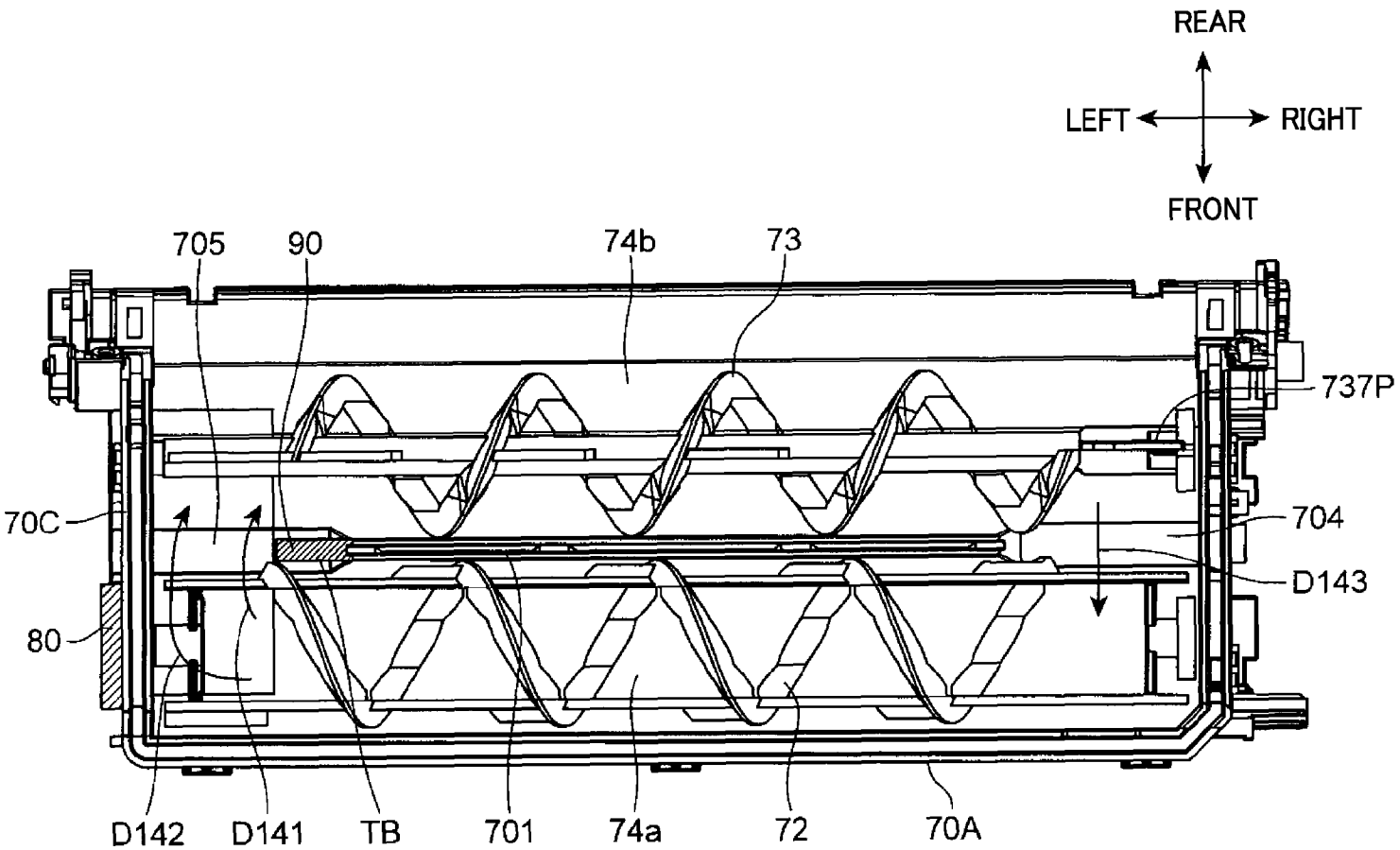
FIG. 14 is a plan view showing a flow of the developer in the development device of the embodiment of the present disclosure.

Next, the auxiliary communication portion DG formed by the auxiliary separation plate 90 of this embodiment will be described with reference to FIGS. 11-14. FIGS. 11 and 12 are schematic perspective views showing a flow of the developer in the development device 70. FIGS. 13 and 14 are plan views showing a flow of the developer in the development device 70. FIGS. 11 and 13 are diagrams showing a case where the developer in the developer reservoir section 74 is brand-new and therefore the flowability of the developer is high. FIGS. 12 and 14 are diagrams showing a case where the developer degrades and therefore the flowability of the developer is low.

As can be seen from FIGS. 11 and 13, when the developer is brand-new and therefore the developer flowability is high, the surface position of the developer is substantially uniform over the entire developer reservoir section 74. On a downstream side of the first conveyance portion 74*a*, a portion of the developer goes down below the auxiliary separation plate 90 (passes through the auxiliary communication portion DG) to be moved to the second conveyance portion 74*b* (an arrow D111 in FIG. 11, an arrow D131 in FIG. 13). The rest of the developer is conveyed to the vicinity of the inner wall of the first wall portion 70C before being moved to the second conveyance portion 74*b* (an arrow D112 in FIG. 11, an arrow D132 in FIG. 13). In this case, the toner sensor 80 detects the developer which is conveyed at the inner wall portion of the first wall portion 70C. As a result, the toner sensor 80 successfully detects the amount of the developer in the developer reservoir section 74. Note that, referring to FIG. 13, on a downstream side of the first conveyance portion 74*a*, the developer passes through the entire region of the first communication portion 705 disposed between the separation plate 701 and the first wall portion 70C (arrows D131 and D132). Also, on a downstream side of the second conveyance portion 74*b*, the developer passes through the entire region of the second communication portion 704 disposed between the separation plate 701 and the second wall portion 70B (an arrow D133). As a result, the circulation of the developer in the developer reservoir section 74 is maintained stable.

On the other hand, as can be seen from FIGS. 12 and 14, when the developer degrades and therefore the developer flowability decreases, the viscosity of the developer increases. As a result, as shown in FIG. 12, the developer is likely to aggregate into an ice column-like shape in the auxiliary communication portion DG whose height in the vertical direction is set to be lower than that of the original first communication portion 705. As a result, the auxiliary communication portion DG is blocked by a region TB where the developer aggregates. When the developer flowability decreases, most of the developer is likely to be moved from a downstream end portion in the conveyance direction (the arrow Da) of the separation plate 701 to the second conveyance portion 74*b* while being moved along the separation plate 701.

However, in this embodiment, because the auxiliary communication portion DG is blocked, the developer which is moved along the separation plate 701 is moved to a region located downstream of the auxiliary communication portion DG in the conveyance direction of the first conveyance portion 74*a*. As a result, as indicated by arrows D121 and D122 in FIG. 12, the developer is moved from a region of the first communication portion 705 which is located downstream of the auxiliary communication portion DG (the auxiliary separation plate 90) in the conveyance direction of the first conveyance portion 74*a*, to the second conveyance portion 74*b*. In this case, the developer having a reduced flowability successfully passes through a region of the first wall portion 70C which faces the toner sensor 80. Therefore, even when the flowability of the developer decreases due to degradation of the developer, the toner sensor 80 successfully detects the amount of the developer in the developer reservoir section 74.

Note that, as can be seen from FIG. 14, on a downstream side of the first conveyance portion 74*a*, the developer passes through a region of the first communication portion 705 which is located downstream of the auxiliary communication portion DG (arrows D141 and D142). In other words, the effective width of the first communication portion 705 through which the developer passes becomes narrower. On the other hand, on a downstream side of the second conveyance portion 74*b*, the developer is allowed to pass through the entire region of the second communication portion 704 disposed between the separation plate 701 and the second wall portion 70B (an arrow D143). As a result, it may seem that the first communication portion 705 and the second communication portion 704 have different widths through which the developer passes, and the circulation of the developer is likely to become unstable.

However, in this embodiment, the conveyance performance (conveyance capability) of the second conveyance screw 73 is set to be slightly higher than that of the first conveyance screw 72. As a result, even when the developer degrades and therefore the developer flowability decreases, the developer is likely to be slightly accumulated in the second communication portion 704 due to the level of the conveyance performance of the second conveyance screw 73. Therefore, the amount of the developer which passes through the first communication portion 705 whose effective width for passage of the developer becomes narrower and the amount of the developer which passes through the second communication portion 704 in which the developer is slightly accumulated, are close to each other. As a result, the circulation of the developer in the developer reservoir section 74 is maintained stable even when the effective width of the first communication portion 705 becomes narrower by providing the auxiliary communication portion DG.

Figure 15B:
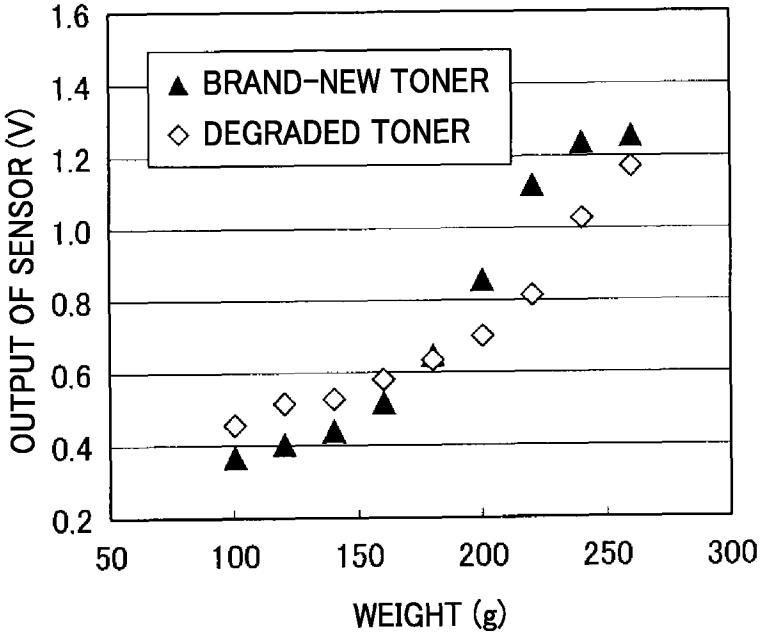
FIG. 15B is a graph for describing an output of a toner sensor for the development device of the embodiment of the present disclosure.
Figure 15A:
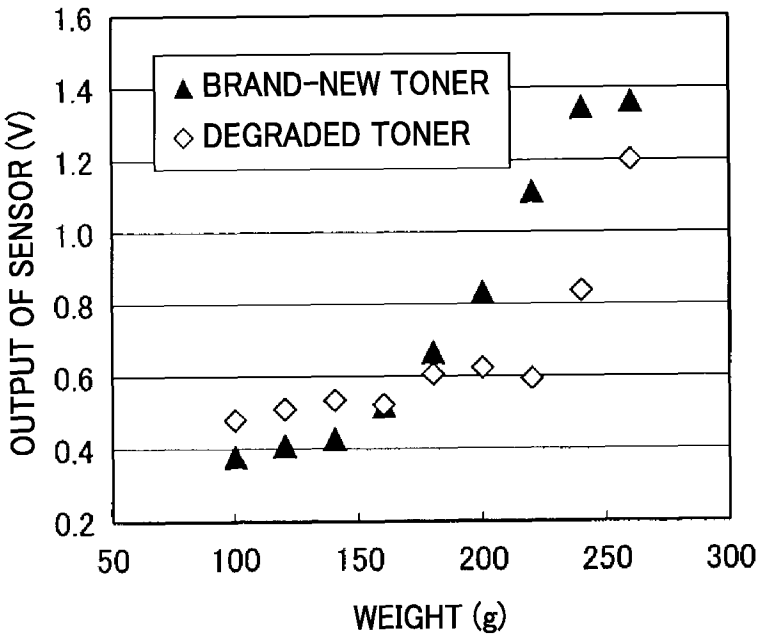
FIG. 15A is a graph for describing an output of a toner sensor for a typical development device.

FIGS. 15A and 15B are graphs for describing an output voltage of the toner sensor 80 which is obtained when the auxiliary separation plate 90 (the auxiliary communication portion DG) of this embodiment is mounted. FIG. 15A is a graph in the absence of the auxiliary separation plate 90, and FIG. 15B is a graph in the presence of the auxiliary separation plate 90. In FIGS. 15A and 15B, the horizontal axis represents the amount (g) of the developer stored in the developer reservoir section 74 in the development housing 70A, and the vertical axis represents the output voltage (V) of the toner sensor 80. As the relationship between the developer amount (g) and the output voltage (V) of the toner sensor 80 is more linear, the detection accuracy of the toner sensor 80 is higher.

As shown in FIG. 15A, when the development device 70 does not include the auxiliary separation plate 90, the relationship between the developer amount and the output voltage of the toner sensor 80 becomes unstable due to degradation of the developer. In particular, when the developer amount is within the range of 100-220 g, even if the developer amount increases, the output voltage of the toner sensor 80 does not increase. This is because the developer having a reduced flowability does not reach the inner wall surface of the first wall portion 70C, and therefore, is not detected by the toner sensor 80.

On the other hand, as shown in FIG. 15B, when the development device 70 includes the auxiliary separation plate 90, then even if the developer degrades, the correlation relationship between the developer amount and the output voltage of the toner sensor 80 is maintained to some extent. This is because when the developer degrades and therefore the developer flowability decreases, the auxiliary communication portion DG is blocked by the developer aggregation region TB, and as a result, the developer reaches the inner wall surface of the first wall portion 70C.

As described with reference to FIG. 10, the auxiliary separation plate 90 is a member (formation member) which forms the auxiliary communication portion DG. This point will be further described. As shown in FIG. 11, the first communication portion 705 of FIG. 3 causes one end portion of the first conveyance portion 74*a* and one end portion of the second conveyance portion 74*b* to be in communication with each other via a communication surface 7040. The communication surface 7040 includes a first region 7041 and a second region 7042. The auxiliary separation plate 90 forms the second region 7042 of the communication surface 7040 so that a height h2 of the second region 7042 from a bottom portion of the first communication portion 705 is lower than a height h1 of the first region 7041 from the bottom portion of the first communication portion 705.

The communication surface 7040 is a cross section of the first communication portion 705 cut along a plane including the separation plate 701 (or the auxiliary separation plate 90). The second region 7042 is a cross section of the auxiliary communication portion DG cut along a plane including the separation plate 701 (or the auxiliary separation plate 90). When the developer is brand-new and therefore the developer flowability is high, a portion of the developer is moved through the second region 7042 (the auxiliary communication portion DG) to the second conveyance portion 74*b* (an arrow D111). The rest of the developer is conveyed to the vicinity of the inner wall of the first wall portion 70C before being moved through the first region 7041 to the second conveyance portion 74*b* (an arrow D112). On the other hand, when the developer degrades and therefore the developer flowability decreases, the aggregation region TB is formed in the second region 7042 (the auxiliary communication portion DG), the developer is moved through the first region 7041 of the communication surface 7040 which is located downstream of the second region 7042 (the auxiliary communication portion DG) to the second conveyance portion 74*b* (arrows D121 and D122 in FIG. 12). The toner sensor 80 is provided on a further downstream side of the first conveyance portion 74*a* than the auxiliary separation plate 90, and detects the amount of the developer. The toner sensor 80 can successfully detect the amount of the developer in the developer reservoir section 74 as independently of the developer flowability as possible.

As described above, in this embodiment, the toner sensor 80 is disposed at the first wall portion 70C on a further downstream side than the auxiliary separation plate 90 in the conveyance direction (the arrow Da of FIG. 3B) of the first conveyance portion 74*a* of the development device 70. The auxiliary separation plate 90 is disposed successive to the separation plate 701 at a downstream end portion in the conveyance direction (the arrow Da) of the separation plate 701. The auxiliary separation plate 90 blocks an upper portion of an upstream region in the conveyance direction (the arrow Da) of the first communication portion 705. If the auxiliary separation plate 90 is not provided, then when the developer which is conveyed through the second conveyance portion 74*b* and the first conveyance portion 74*a* to circulate degrades and therefore the developer flowability decreases, it is difficult for the developer conveyed by the first conveyance screw 72 having the hollow helical shape to reach the first wall portion 70C at which the toner sensor 80 is provided. Note that, in this embodiment, the development device 70 includes the auxiliary separation plate 90. As a result, when the developer flowability decreases, the developer adheres to a lower end portion of the auxiliary separation plate 90. A region below the auxiliary separation plate 90 is eventually blocked by the developer. Therefore, the developer conveyed in the first conveyance portion 74*a* is conveyed to a region which is located downstream of the auxiliary separation plate 90. As a result, the developer passes through a region which the toner sensor 80 faces, and therefore, the toner sensor 80 successfully detects the amount of the developer.

In this embodiment, the auxiliary separation plate 90 is disposed on the lid portion 70D of the development device 70. As a result, by combining the development housing 70A and the lid portion 70D, the auxiliary separation plate 90 can be disposed in the development housing 70A.

In this embodiment, in addition to the first conveyance screw 72, the second conveyance screw 73 also has a helical shape having a hollow interior. Therefore, the first and second conveyance portions 74*a* and 74*b* have close levels of developer conveyance performance. As a result, the flow of the developer circulating through the first and second conveyance portions 74*a* and 74*b* is maintained stable.

In this embodiment, the first first-tip portion 722A of the first conveyance screw 72 is provided at an end portion of the first first-rib 722, protruding beyond the first first-connection piece 724 toward the first wall portion 70C. As a result, on a downstream side in the conveyance direction of the first conveyance portion 74*a*, the first first-tip portion 722A successfully stirs the developer located between the first first-connection piece 724 and the first wall portion 70C as the first conveyance screw 72 rotates. Therefore, the toner sensor 80 also accurately detects the amount of the developer.

In this embodiment, the first and second first-ribs 722 and 723 are disposed with a spacing therebetween in the circumferential direction of rotation of the second conveyance member. The first and second first-tip portions 722A and 723A protrude from end portions of the first and second first-ribs 722 and 723, respectively. Therefore, the two tip portions successfully stir the developer located between the first first-connection piece 724 and the first wall portion 70C.

In this embodiment, the second first-protruding portion 729 is provided at a downstream end portion in the conveyance direction (the arrow Da) of the first first-rib 722, facing the first communication portion 705 and protruding toward the radial direction of rotation of the first conveyance screw 72. Therefore, as the first conveyance screw 72 rotates, the second first-protruding portion 729 successfully transfers the developer from the first conveyance portion 74*a* to the second conveyance portion 74*b*. As a result, the circulation of the developer between the first and second conveyance portions 74*a* and 74*b* is maintained stable.

In this embodiment, the developer used in the development device 70 is a single-component toner. As a result, even when the toner degrades, the toner sensor 80 successfully detects the amount of the toner in the development device 70.

In this embodiment, the image forming apparatus 1 includes the photoconductive drum 31 and the development device 70. An electrostatic latent image is formed on the circumferential surface of the photoconductive drum 31. The photoconductive drum 31 is disposed to face the development roller 71. Even when the developer flowability decreases, the developer conveyed in the first conveyance portion 74*a* is conveyed to a region which is located downstream of the auxiliary separation plate 90. As a result, the developer passes through a region which the toner sensor 80 faces, and therefore, the toner sensor 80 successfully detects the amount of the developer. Therefore, an image is formed on the photoconductive drum 31 while the amount of the developer in the development housing 70A is successfully managed.

In the foregoing, the development device 70 of the embodiment of the present disclosure, and the image forming apparatus 1 including the development device 70, have been described. The present disclosure is not intended to be limited to this. For example, variations can be made as follows.

(1) Although the auxiliary separation plate 90 described with reference to FIG. 9 is provided on the lid portion 70D, the present disclosure is not limited to this. For example, the auxiliary separation plate 90 may be provided on the development housing 70A. Alternatively, for example, the auxiliary separation plate 90 may be provided as a portion of the separation plate 701.

(2) Although the toner sensor 80 described with reference to FIG. 8 is disposed at the first wall portion 70C on a downstream side in the conveyance direction of the first conveyance portion 74*a*, the present disclosure is not limited to this. For example, the toner sensor 80 may be disposed at the first wall portion 70C, straddling the first and second conveyance portions 74*a* and 74*b*. Alternatively, for example, the toner sensor 80 may be disposed at a wall portion around the first communication portion 705.

(3) The development housing 70A (including the first conveyance portion 74*a*, the second conveyance portion 74*b*, the first communication portion 705, and the second communication portion 704), the auxiliary separation plate 90, the toner sensor 80, the lid portion 70D, the separation plate 701, the first conveyance screw 72, and the second conveyance screw 73 of FIG. 3 constitute a portion of the development device 70. Note that these members are members for conveying the developer, and therefore, in this sense, constitute a conveyance device. In this conveyance device, the auxiliary separation plate 90 forms the auxiliary communication portion DG (the second region 7042) (see FIG. 11). As a result, the toner sensor 80 can successfully detect the amount of the developer as independently of a change in the developer flowability as possible.

Note that when the conveyance device includes the development housing 70A (including the first conveyance portion 74*a*, the second conveyance portion 74*b*, and the first communication portion 705), the auxiliary separation plate 90, and the toner sensor 80, then if the auxiliary communication portion DG is formed, the toner sensor 80 can successfully detect the amount of the developer as independently of a change in the developer flowability as possible.

(4) As shown in FIG. 3, the first and second conveyance portions 74*a* and 74*b* are separated from each other by the separation plate 701. Note that any other means or member may be used to form the first and second conveyance portions 74*a* and 74*b* as long as the first and second conveyance portions 74*a* and 74*b* can be formed as separate conveyance paths. As shown in FIG. 3, the first and second conveyance screws 72 and 73 each have a hollow helical shape. Note that the first conveyance screw 72 does not necessarily need to have a hollow helical shape. This is because, even when the first conveyance screw 72 does not have a hollow helical shape, then if the conveyance performance is inherently low or is set to be low, it is effective to provide the auxiliary separation plate 90 in order to detect the amount of the developer as independently of a change in the developer flowability as possible. The second conveyance screw 73 also does not necessarily need to have a hollow helical shape. For example, the first conveyance screw 72 may have a hollow helical shape while the second conveyance screw 73 may have other shapes (e.g., a non-hollow helical shape).

(5) As shown in FIG. 3A, the first inner wall portion 721S is in the shape of a generally equilateral octagon. Note that the first inner wall portion 721S is not limited to the generally equilateral octagon, and may be in the shape of other polygons, as viewed in cross section perpendicular to the axial direction of the first conveyance screw 72. The second inner wall portion 731S is also not limited to the generally equilateral octagon, and may be in the shape of other polygons.

As described above, according to the embodiment of the present disclosure, a development device including a developer conveyance member having a hollow shape successfully detects the amount of a developer even when a toner sensor is provided in the vicinity of a communication portion between two conveyance paths.

The invention claimed is:

1. A conveyance device comprising:

a housing including a first wall portion and a second wall portion facing one another, a first conveyance path provided between the first and second wall portions and configured to convey a developer, a second conveyance path provided between the first and the second wall portions and configured to convey the developer, a separation plate configured to separate the first and second conveyance paths, and a first communication path configured to allow a first end portion of the first conveyance path and a first end portion of the second conveyance path to be in communication with each other via a communication surface, the communication surface including a first region and a second region;

a formation member configured to form the second region of the communication surface so that a height of the second region from a bottom portion of the first communication path is lower than a height of the first region from the bottom portion of the first communication path;

a detection section provided in the first wall portion, downstream of the formation member in the first conveyance path, and configured to detect an amount of the developer, and a lid mounted to an upper portion of the housing and configured to cover the first and second conveyance paths, wherein the first wall portion intersects a conveyance direction of the developer in the first conveyance path and a conveyance direction of the developer in the second conveyance path, the formation member is a plate-like member disposed downstream of the separation plate in the first conveyance path and successive to the separation plate, and the formation member is parallel to the separation plate, the formation member is provided on the lid, the formation member protrudes from the lid in a substantially vertical direction and has a first lateral edge, a second lateral edge, and a lower end edge, the first lateral edge of the formation member is disposed along an end edge of the separation plate such that the formation member and the separation plate are successive, the second lateral edge of the formation member is disposed facing the first wall portion, and the lower end edge of the formation member is disposed facing the bottom portion of the first communication path with distance therebetween.

2. The conveyance device of claim 1, further comprising:

a first conveyance member provided in the first conveyance path and configured to rotate and convey the developer in a first direction; and a second conveyance member provided in the second conveyance path and configured to rotate and convey the developer in a second direction different from the first direction, wherein the housing includes a second communication path configured to allow a second end portion of the first conveyance path and a second end portion of the second conveyance path to be in communication with each other.

3. The conveyance device of claim 2, wherein the first conveyance member has a hollow helical shape.

4. The conveyance device of claim 3, wherein the second conveyance member has a hollow helical shape.

5. The conveyance device of claim 3, wherein the first conveyance member includes a hollow helical member including a plurality of helical pieces joined successively so that the hollow helical member extends in the first direction, two shaft portions provided at opposite ends of the helical member and rotatably supported by the first wall portion and the second wall portion, a reinforcement member configured to connect adjacent ones of the plurality of helical pieces, and extend in the first direction, and a support member joined to an end portion of the reinforcement member.

6. The conveyance device of claim 5, wherein one tip portion of the reinforcement member protrudes beyond the support member toward the first wall portion, at the first end portion of the first conveyance path.

7. The conveyance device of claim 5, wherein the first conveyance member further includes a protruding member protruding from the end portion of the reinforcement member in a radial direction of rotation of the first conveyance member, at the first end portion of the first conveyance path.

8. The conveyance device of claim 5, wherein the first conveyance member further includes a ring-shaped elastic member provided on an outside in a radial direction of the shaft portion, at the second end portion of the first conveyance path.

9. The conveyance device of claim 3, wherein the first conveyance member includes a hollow helical member including a plurality of helical pieces joined successively so that the hollow helical member extends in the first direction, two shaft portions provided at opposite ends of the helical member and rotatably supported by the first wall portion and the second wall portion, a first reinforcement member configured to connect adjacent ones of the plurality of helical pieces, and extending in the first direction, and a second reinforcement member configured to connect adjacent ones of the plurality of helical pieces, and extending in the first direction, and a support member configured to connect an end portion of the first reinforcement member and an end portion of the second reinforcement member together.

10. The conveyance device of claim 9, wherein one tip portion of the first reinforcement member and one tip portion of the second reinforcement member protrude beyond the support member toward the first wall portion, at the first end portion of the first conveyance path.

11. The conveyance device of claim 9, wherein the first conveyance member further includes a protruding member protruding from the end portion of the first reinforcement member in a radial direction of rotation of the first conveyance member, at the first end portion of the first conveyance path.

12. The conveyance device of claim 9, wherein the first conveyance member further includes a ring-shaped elastic member provided on an outside in a radial direction of the shaft portion, at the second end portion of the first conveyance path.

13. The conveyance device of claim 3, wherein the first conveyance member includes an inner wall portion facing a hollow interior, and the inner wall portion has a plurality of inner wall surfaces forming a polygonal shape as viewed in a cross section perpendicular to an axial direction of the first conveyance member.

14. The conveyance device of claim 1, wherein the developer is a single-component toner.

15. A development device comprising:

the conveyance device of claim 1; and a development roller provided along the second conveyance path and rotatably supported by the housing, wherein the development roller carries the developer.

16. An image forming apparatus comprising:

the development device of claim 15; and an image carrier having a circumferential surface on which an electrostatic latent image is to be formed, and disposed to face the development roller.

17. The conveyance device of claim 1, wherein the housing further includes an auxiliary communication path that is a spacing formed below the formation member, the communication surface is a cross section of the first communication path cut along a plane including the separation plate, and the second region is a cross section of the auxiliary communication path cut along the plane.

18. The conveyance device of claim 1, wherein the formation member blocks an upper portion of an upstream region of the first communication path.

* * * * *